US010316846B2

(12) United States Patent
Davis

(10) Patent No.: US 10,316,846 B2
(45) Date of Patent: Jun. 11, 2019

(54) HYBRID RADIAL AXIAL CUTTER

(71) Applicant: Eco-Flo Products, Inc., Ashland, OH (US)

(72) Inventor: Jason Davis, Ashland, OH (US)

(73) Assignee: Eco-Flo Products, Inc., Ashland, OH (US)

( * ) Notice: Subject to any disclaimer, the term of this patent is extended or adjusted under 35 U.S.C. 154(b) by 530 days.

(21) Appl. No.: 15/180,705

(22) Filed: Jun. 13, 2016

(65) Prior Publication Data

US 2016/0363123 A1 Dec. 15, 2016

Related U.S. Application Data

(60) Provisional application No. 62/174,226, filed on Jun. 11, 2015.

(51) Int. Cl.

| | |
|---|---|
| ***F04D 7/04*** | (2006.01) |
| ***F04D 29/42*** | (2006.01) |
| ***F04D 29/22*** | (2006.01) |

(52) U.S. Cl.

CPC ..... *F04D 7/045* (2013.01); *F04D 29/2288* (2013.01); *F04D 29/4293* (2013.01); *F05D 2230/60* (2013.01)

(58) Field of Classification Search

CPC .. F04D 7/045; F04D 29/2288; F04D 29/4293; F05D 2230/60

USPC ..... 415/121.1

See application file for complete search history.

(56) References Cited

U.S. PATENT DOCUMENTS 2,658,453 A * 11/1953 Walters ..... F04D 1/006 241/101.2
3,960,333 A * 6/1976 Woods ..... F04D 7/045 241/46.15
3,982,700 A * 9/1976 Love ..... B01F 5/16 241/46.11
4,201,345 A * 5/1980 Ziegler ..... A47L 15/4227 241/46.012
4,408,724 A * 10/1983 Meyer ..... F04D 7/045 241/46.17

(Continued)

FOREIGN PATENT DOCUMENTS

KR 10-1036955 B1 5/2011

OTHER PUBLICATIONS

Liberty Pumps, Inc., Omnivore Grinders, LSG200-Series, 2011, 4 pages.

(Continued)

*Primary Examiner* — Carlos A Rivera
*Assistant Examiner* — Adam W Brown
(74) *Attorney, Agent, or Firm* — Tucker Ellis LLP; Michael G. Craig

(57) ABSTRACT

One or more techniques and/or systems are disclosed for a cutter/grinder system that can be engaged with a pump. The cutter/grinder system can comprise an axial cutting operation and a radial cutting operation, comprising a rotary cutter that has both radial and axial cutting edges. The rotating cutter can be operably engaged with a stationary cutter apparatus, non-movably engaged with a pump, where the stationary cutter apparatus comprises both an axial cutting operation and a radial cutting operation, comprising both radial and axial cutting edges. The system can facilitate reduction of a size of solids that may be entrained in a target fluid.

20 Claims, 29 Drawing Sheets

(56) References Cited

U.S. PATENT DOCUMENTS 4,430,214 A * 2/1984 Baker ..... E04H 4/1209 210/167.12
4,527,947 A * 7/1985 Elliott ..... F04D 7/045 415/121.1
4,728,256 A * 3/1988 Araoka ..... F04D 7/045 415/121.1
4,778,336 A 10/1988 Husain
5,016,825 A * 5/1991 Carpenter ..... F04D 7/045 241/258
5,044,566 A 9/1991 Mitsch
5,456,580 A * 10/1995 Dorsch ..... B02C 18/0092 415/121.1
6,010,086 A 1/2000 Earle, III et al.
6,190,121 B1 2/2001 Hayward et al.
6,224,331 B1 * 5/2001 Hayward ..... F04D 7/045 415/121.1
6,969,018 B2 11/2005 Gimenez Ibanez et al.
7,159,806 B1 * 1/2007 Ritsema ..... B02C 18/0092 241/258
7,237,736 B1 7/2007 Martin
7,584,916 B2 9/2009 Shaw
7,841,826 B1 * 11/2010 Phillips ..... E21B 43/128 415/121.1
7,841,827 B2 * 11/2010 Keener ..... F04D 29/2288 415/121.1
8,105,017 B2 * 1/2012 Dorsch ..... F04D 29/2288 415/121.1
8,267,643 B2 * 9/2012 Wagner ..... F04D 7/045 415/121.1
8,511,998 B2 * 8/2013 Burgess ..... F04D 29/2288 29/402.08
8,562,287 B2 * 10/2013 Schmidt ..... E03F 5/22 415/121.1
8,657,564 B2 * 2/2014 Cuppetelli ..... F04D 29/2288 415/121.1
8,784,038 B2 * 7/2014 Ciotola ..... B02C 18/0092 241/21
2015/0377255 A1 12/2015 Mitsch

OTHER PUBLICATIONS

Pentair Ltd., Myers V2 Grinder Series, 2014-2015, 6 pages.
Crane Pumps & Systems, Inc., Barnes, Omni Grind Centrifugal Grinder Pumps, 2012, 2 pages.
PCT International Search Report and Written Opinion from International Application No. PCT/US2016/037238, dated Sep. 12, 2016, 10 pages.

* cited by examiner

HYBRID RADIAL AXIAL CUTTER

CROSS-REFERENCE TO RELATED APPLICATIONS

This application claims priority to U.S. Provisional Patent Application Ser. No. 62/174,226 entitled HYBRID RADIAL AXIAL CUTTER, filed Jun. 11, 2015, which is incorporated herein by reference.

BACKGROUND

A cutter/grinder pump system is used as a wastewater conveyance system that has the ability to reduce the size of solid matter that may be entrained in the target fluid. Waste from water-using systems in commercial and household settings, such as appliances (e.g., toilets, bathtubs, washing machines, etc.) and other components, can be transported to a holding tank in which the grinder pump is disposed. Upon activation, the pump can be used to cut and/or grind the solids entrained fluid waste into a fine slurry, and pump it to a treatment system handling conduit (e.g., central processing or septic system). A grinder pump and cutter pump are different from a typical effluent pump in that a cutter or grinder assembly is installed that reduces solids prior to entry into the pump.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

As provided herein, cutter/grinder system that can be engaged with a pump to facilitate reduction of solids that may be entrained in a target fluid. An example cutter/grinder system may cut and/or grind solid matter such that the reduced sized matter can be converted in a more efficient and effective manner, for example, by using less energy to provide similar performance as a higher energy consuming system. For example, an exemplary cutter/grinder system may utilize both an axial cutting operation and a radial cutting operation, comprising a rotary cutter system that has both radial and axial cutting edges.

In one implementation, a cutter system for a pump can comprise a stationary cutter plate configured to operably couple with a pump in a stationary disposition at an intake area of the pump. The stationary cutter plate can comprise a plurality of intake ports respectively comprising a stationary cutting edge. Intake ports can comprise a first set of intake ports disposed around a perimeter portion of the stationary cutter plate; and a second set of intake ports disposed at an interior portion of the stationary cutter plate. Further, the cutter system can comprise a stationary cutter wall fixedly engaged with the stationary cutter plate in a substantially transverse direction from the perimeter of the intake side of the stationary cutter plate. The stationary cutter wall can comprise a wall cutting edge disposed in substantial alignment with the respective first set of intake ports. Additionally, the stationary cutter plate can comprise a rotating cutter configured to operably couple with a rotating shaft of the pump. The rotating cutter can comprise a plurality of cutting arms projecting radially from a central hub portion of the rotating cutter, an axial cutting edge disposed on respective cutting arms substantially parallel to the intake surface of the stationary cutter plate, and a radial cutting edge disposed on a distal end of respective cutting arms substantially parallel to an interior side of the stationary cutter wall.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein.

DETAILED DESCRIPTION

Figure 1:
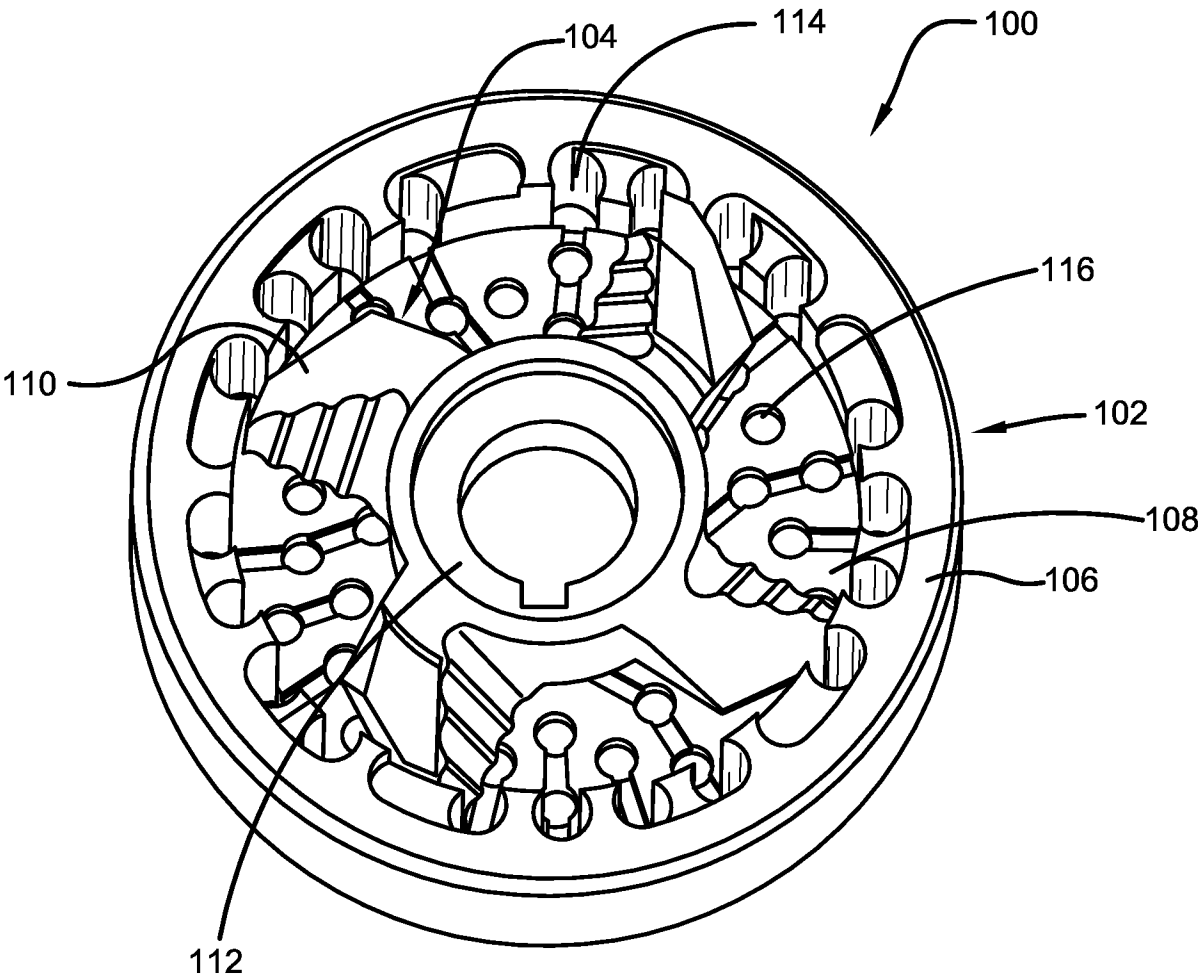
FIG. 1 is a component diagram illustrating a top view of an example implementation of an exemplary hybrid axial radial cutter assembly.
Figure 2:
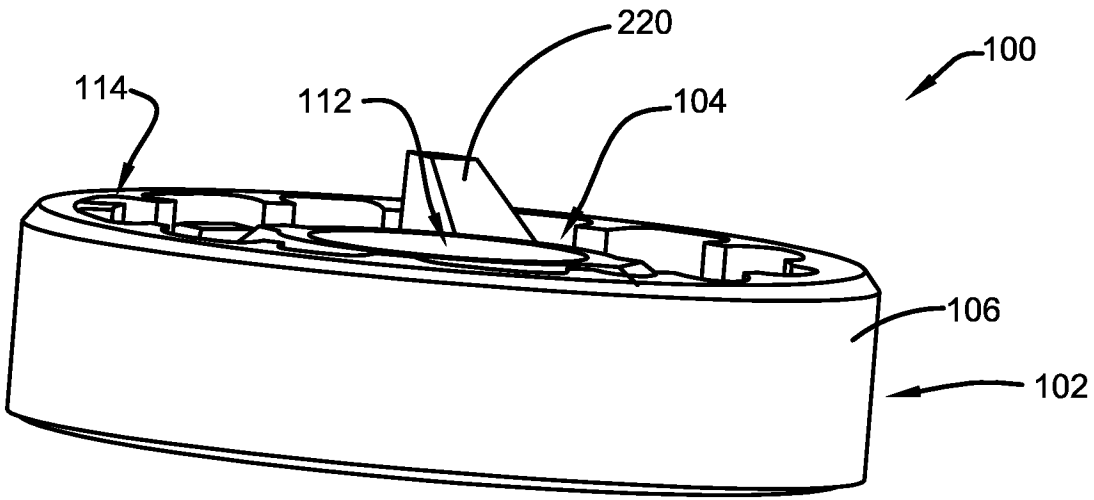
FIG. 2 is a component diagram illustrating a side view of an example implementation of one or more portions of one or more components described herein.
Figure 3:
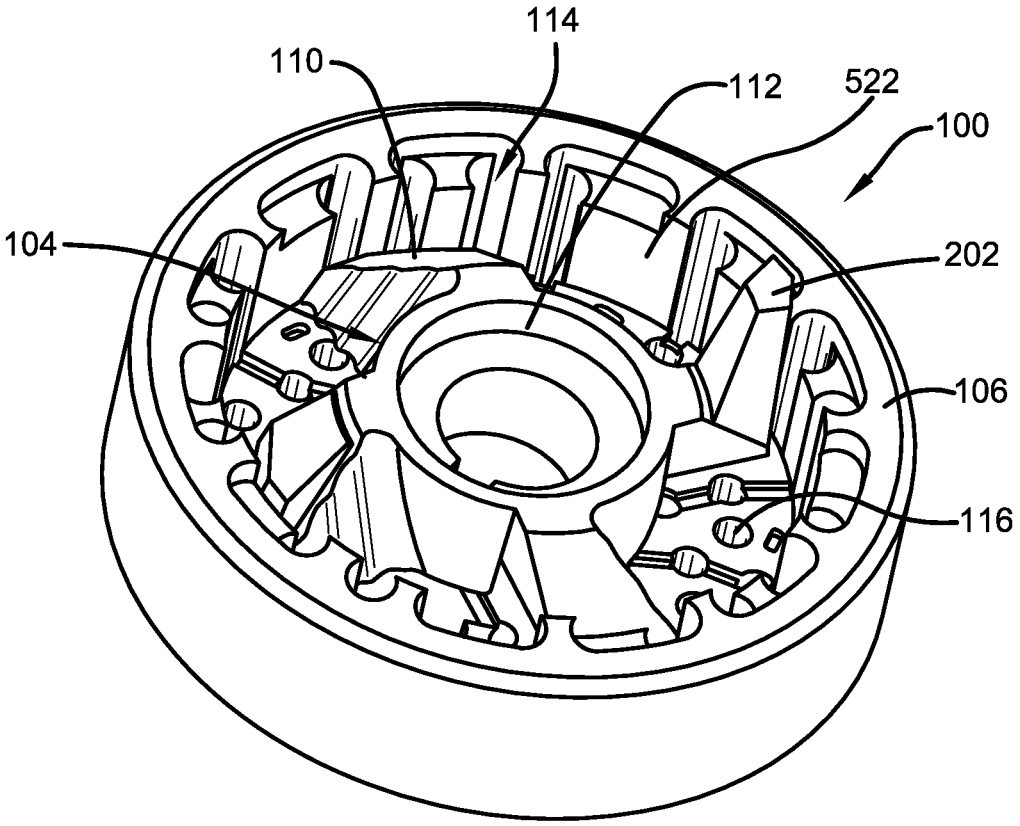
FIG. 3 is a component diagram illustrating a perspective view of an example implementation of one or more portions of one or more components described herein.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices may be shown in block diagram form in order to facilitate describing the claimed subject matter.

A cutter/grinder system may be devised that can be operably coupled with a fluids pump to facilitate degradation of solids, in order to improve pumping of fluids that may comprise entrained solids. That is, for example, an example cutter/grinder system, described herein, may cut and/or grind solid matter mixed with the fluid to a smaller size, such that the reduced-sized matter can be effectively pumped with the fluid. Further, an example cutter/grinder system, described herein, may perform such cutting/grinding in a more efficient and effective manner than previously available systems, for example, by using less energy to provide similar performance as a higher energy consuming system. In one implementation, the exemplary cutter/grinder system may utilize an axial cutting operation and a radial cutting operation. As an example, the system can comprise a rotary cutter that has both radial and axial cutting edges, and a stationary cutting portion that has both radial and axial cutting edges. In this example, rotation of the rotary cutter allows its radial and axial cutting edges to operably engage with the corresponding radial and axial cutting edges of the stationary cutter. In this way, an improved solids size reduction may be obtained.

In one aspect, a radial portion of the hybrid cutter/grinder system can be used to grind solids found in typical wastewater into a fine slurry, which may be preferable to help with downstream pumping and flow, and to reduce equipment maintenance issues. Further, in this aspect, an axial portion of the hybrid cutter/grinder system can be used to cut stringy solids and other forms of non-human waste in to pieces small enough to pass through a small diameter discharge pipe, which may be smaller than those found in systems without a cutter/grinder pump, for example. As an example, it may be the small diameter (e.g., typically one and one quarter inches) of the downstream pipe that gives the grinder pump its up-front capital cost advantages over a typical gravity and large pump lift station. In this aspect, in one implementation, the combination of the radial and axial portions in the hybrid cutter/grinder system may provide for the preferred particle size to produce a desired slurry of solids, while reducing the size of stringy solids without the typical clogging issues that often accompany them.

FIGS. 1-4 are component diagrams illustrating various views of an example implementation of a cutter/grinder system 100, as described herein. In this implementation, the cutter/grinder system 100 can comprise a stationary cutter 102 and a movable cutter 104. The stationary cutter 102 can comprise a perimeter wall 106 and a base plate 108. In some implementations, the perimeter wall 106 and base plate 108 may be integral (e.g., integrally formed), may be fixedly engaged (e.g., fastened together), or may be selectably coupled (e.g., to each other, or separately to a pump). Further, the perimeter wall 106 can extend in a transverse direction from the base plate 108, around the perimeter of the base plate 108. In this implementation, the movable cutter 104 can comprise a plurality of radial arms 110 and a hub portion 112, from which the radial arms 110 extend radially.

In one implementation, the movable cutter 104 can be configured to rotate within a space formed by the perimeter wall 106 and base plate 108. In this implementation, the rotating movable cutter 104 can provide a cutting and/or grinding action in combination with a stationary cutter, for example, providing a radial cutting and/or grinding action where the perimeter wall 106 and radial end of the radial arms 110 interact; and an axial cutting and/or grinding action where the base plate 108 and leading edge of the radial arms 110 interact. That is, for example, the exemplary system 100 may provide both a radial and axial cutting/grinding action for solids entrained in a fluid.

With continued reference to FIGS. 1-4, FIGS. 5-7 are component diagrams illustrating various views of a portion of the cutter/grinder system 100, as described herein. In this implementation, the stationary cutter 102 can comprise a first set of intake ports 114 (e.g., perimeter intake ports) disposed around the perimeter of the stationary cutter's base plate 108. Further, the stationary cutter 102 can comprise a second set of intake ports 116 (e.g., interior intake ports) disposed at an interior portion of the base plate 108. In one implementation, the stationary cutter 102 can be disposed at an intake portion of a pump, such as a wastewater pump. In this implementation, the first set of intake ports 114 and/or the second set of intake ports 116 can be configured to be conduits for fluid (e.g., wastewater) pumped into the pumping system.

Further, at least a portion of the respective intake ports from the second set of intake ports 116 can comprise a base intake port cutting edge 526 that is configured to provide a stationary, axial cutting edge on the base 102. For example, in combination with a rotating cutting arm (e.g., 110 of FIG. 1), the base intake port cutting edge 526 can provide a shearing, scissor-like cutting action on solid material that may be drawn to the intake port 116. That is, for example, the pump may draw the fluid comprising the solid matter toward its intake area, and at least a portion of the solids may enter one or more of the interior intake ports 116. In this example, the rotating cutting arm can create a shearing action with the base intake port cutting edge 526 to cut, chop, and/or grind the solid matter into a smaller size so that it can more easily enter the interior intake ports 116, and be less likely to create clogging issues.

Figure 4:
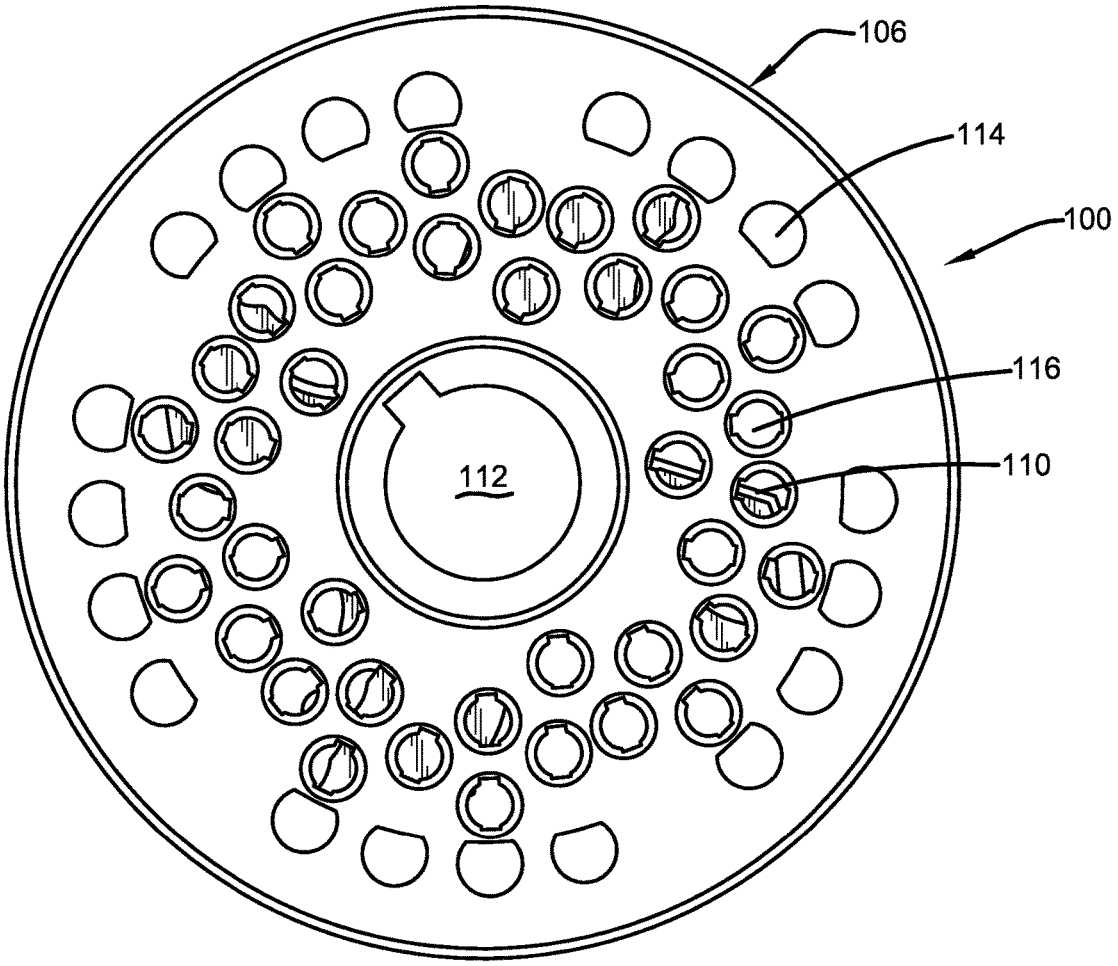
FIG. 4 is a component diagram illustrating a bottom view of an example implementation of one or more portions of one or more components described herein.
Figure 6:
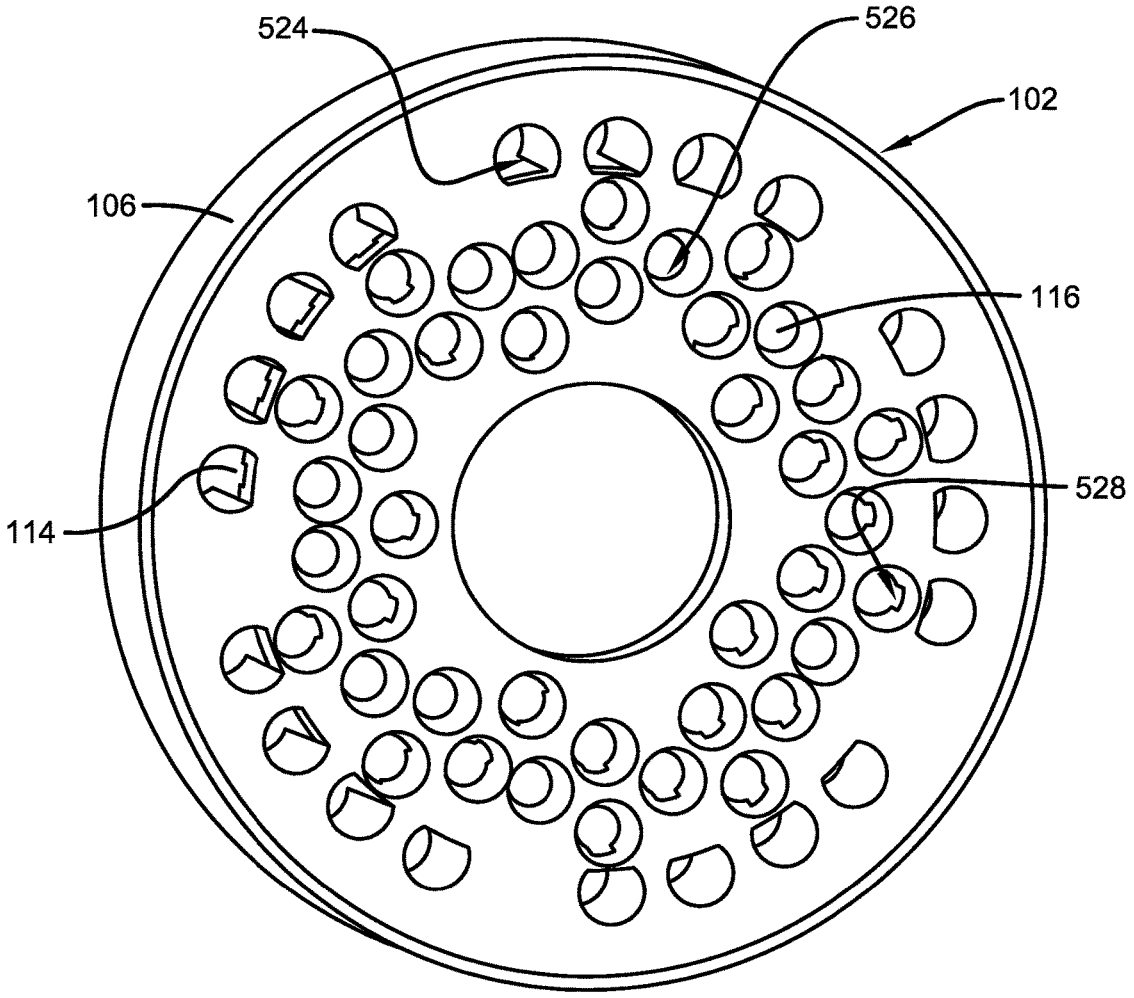
FIG. 6 is a component diagram illustrating a bottom view of an example implementation of one or more portions of one or more components described herein.

In one implementation, as illustrated in FIGS. 4 and 6, the respective interior intake ports 116 may comprise a frusto-conical shape, for example, where the top of the frustum shape is disposed on the intake side of the base plate 108, and the bottom of the frustum is disposed at the outlet side of the base plate 108. As an example, having the top of the frustum disposed at the site of the intake port cutting edge 526 may provide a more acute cutting edge angle. In this way, for example, the intake port cutting edge 526 may provide an improved cutting edge, while the larger diameter of the outlet side of the frustum provides for improved fluid flow (e.g., comprising solids).

Additionally, a perimeter wall of the stationary cutter 102 can comprise an inside portion 522 (e.g., interior side of wall). In one implementation, the inside portion of the wall 522 can comprise a radial cutting edge 524 (e.g., cutting edge of perimeter intake port) at the respective first set of intake ports 114. In this implementation, respective radial cutting edges 524 can be disposed orthogonally from the base plate 108. For example, in this orientation (e.g., parallel to the wall, or transverse from the surface of the base plate 108) they can create a radial cutting surface. In this example, in combination with a terminal end of a rotating cutting arm, the radial cutting edge 524 may provide a second shearing, scissor-like cutting action on solid material that is drawn to the intake port 114, or may migrate to the inside portion of the wall 522 through centrifugal force provided by the rotating cutting arm. That is, for example, the pump may draw the fluid with solid matter toward its intake area, and at least a portion of the solids may enter one or more of the perimeter intake ports 114. In this example, the terminal end of the rotating cutting arm can create a shearing action with the wall intake port cutting edge 524 to cut, chop, and/or grind the solid matter into a smaller size.

Figure 5:
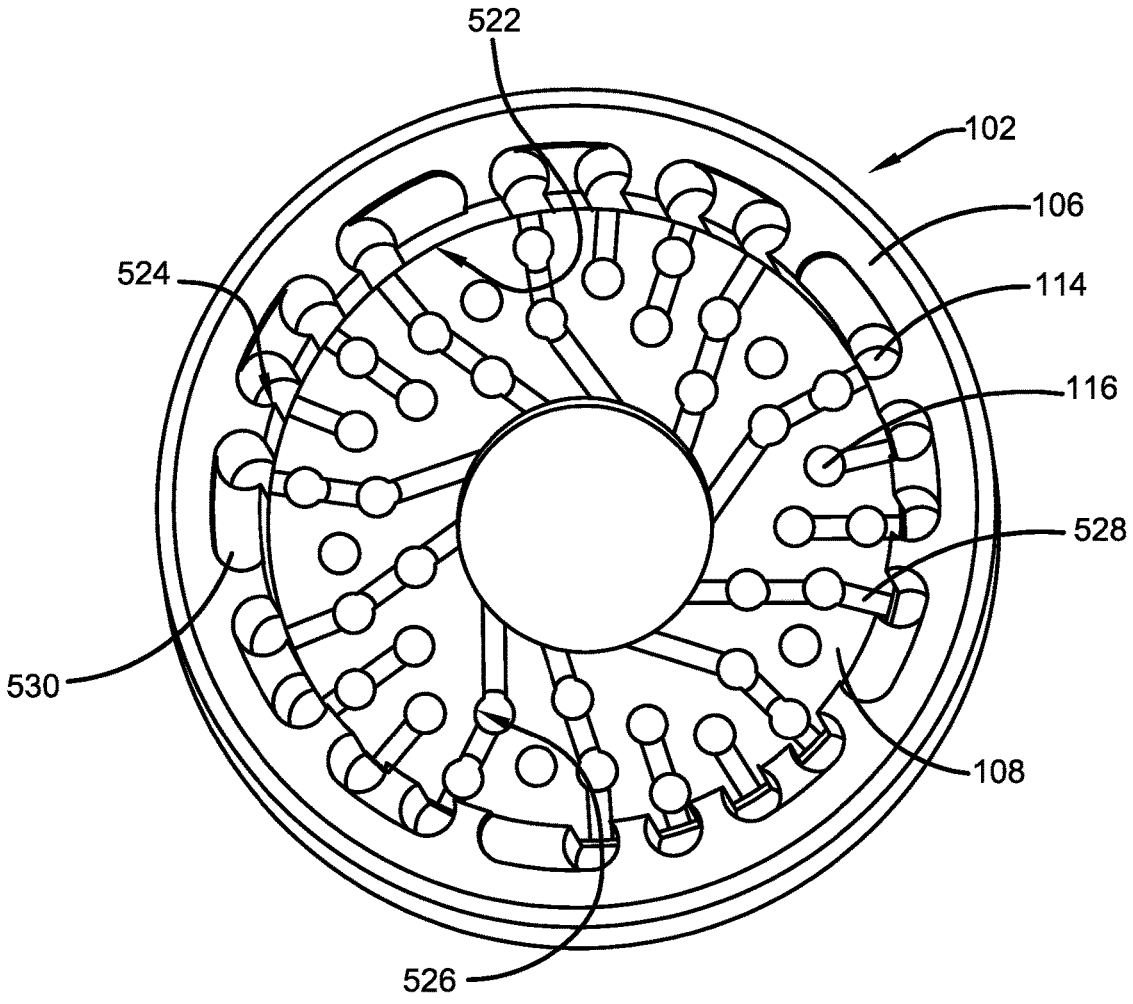
FIG. 5 is a component diagram illustrating a top view of an example implementation of one or more portions of one or more components described herein.
Figure 7:
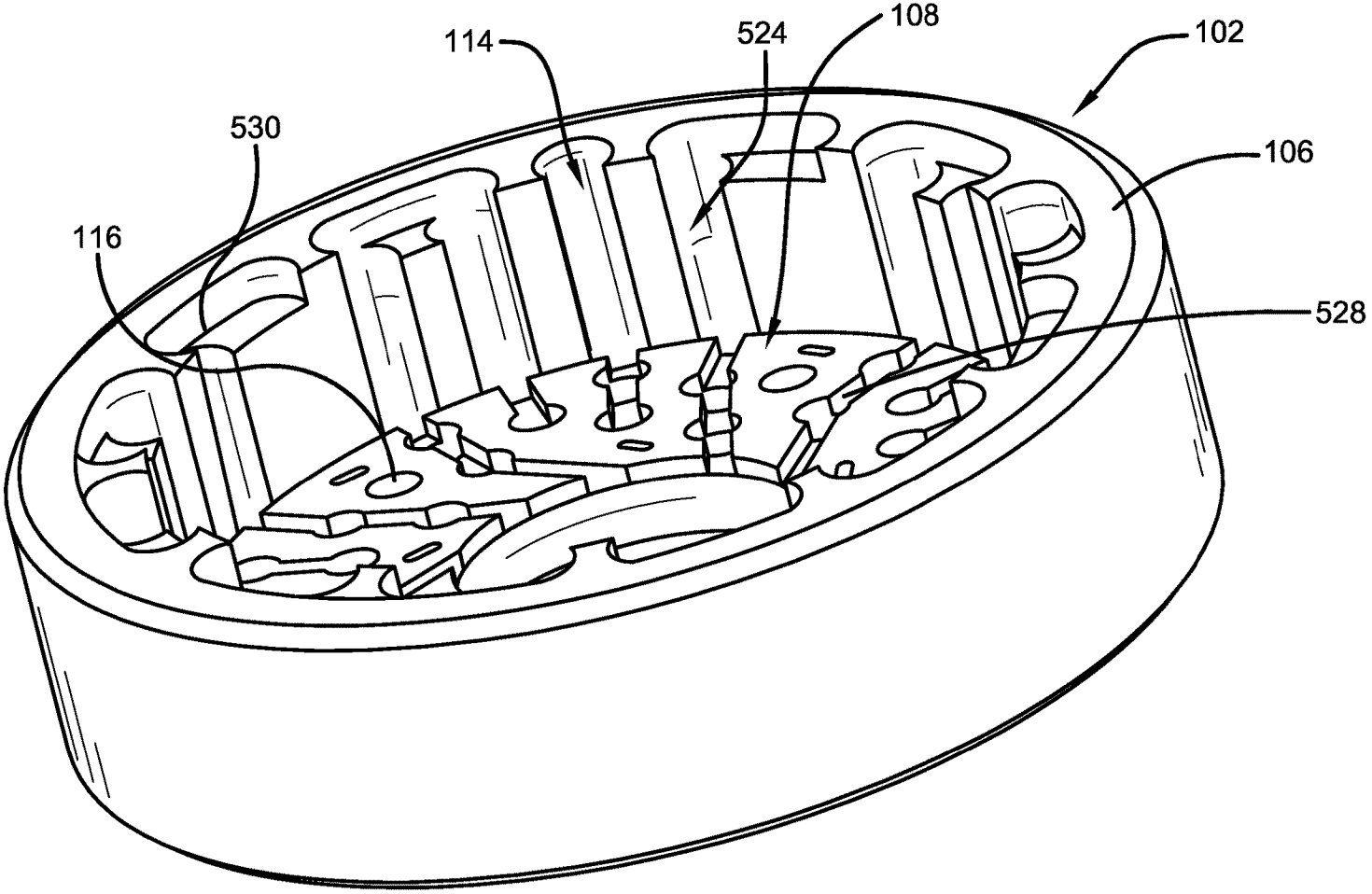
FIG. 7 is a component diagram illustrating a perspective view of an example implementation of one or more portions of one or more components described herein.
Figure 8:
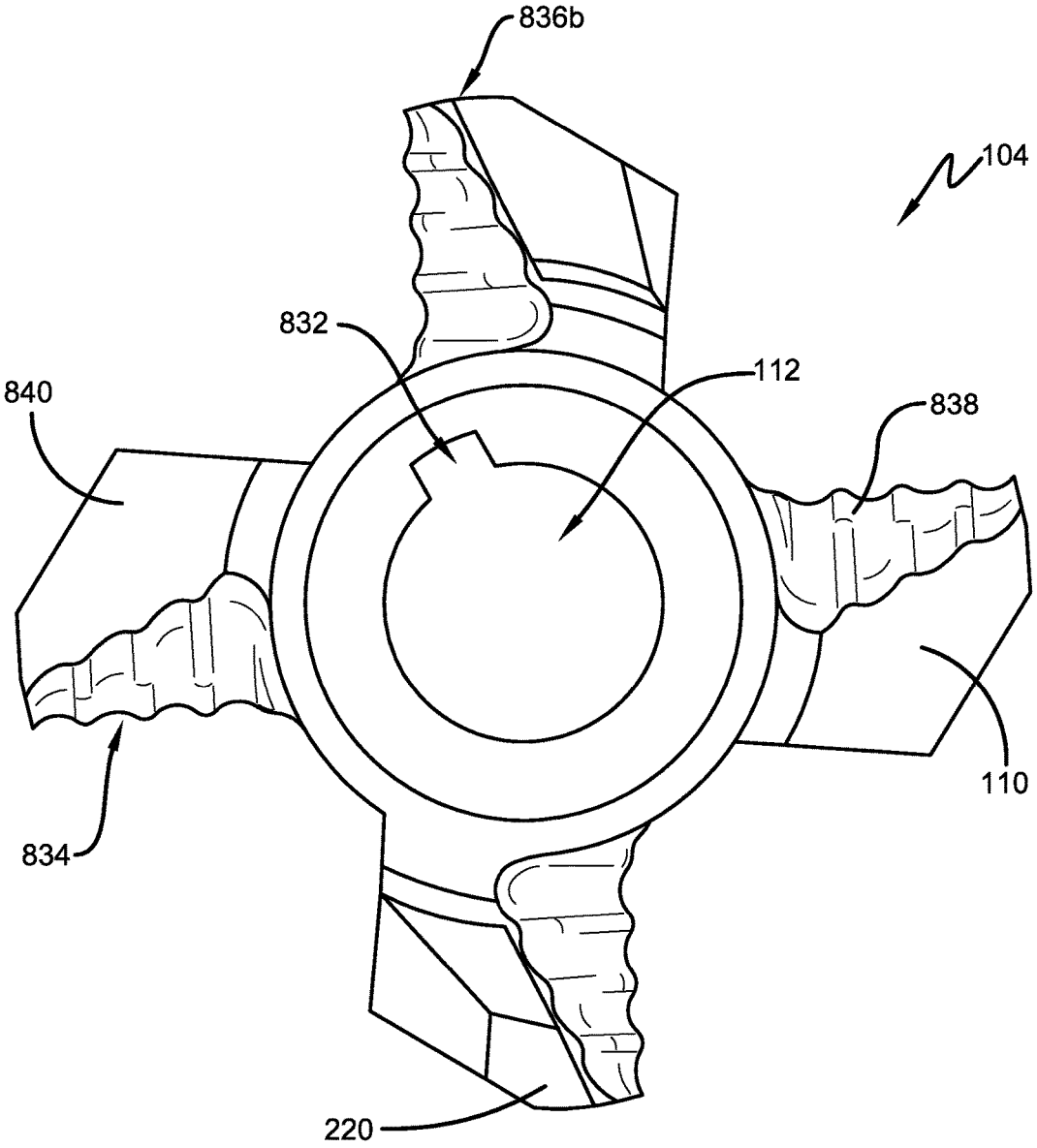
FIG. 8 is a component diagram illustrating a top view of an example implementation of one or more portions of one or more components described herein.

As illustrated in FIGS. 5-7, the example stationary cutter 102 can comprise one or more channels 528, disposed on the intake side of the base plate 108. In one implementation, a channel 528 can be configured to facilitate translation of fluid and/or solids from a central area (e.g., the hub portion 112) toward the inside portion of the wall 522. Further, in one implementation, a channel may be disposed between the hub portion 112 and the inside portion of the wall 522, such as leading to respective perimeter intake ports 114. Additionally, one or more interior intake ports 116 may be disposed along a channel 528. In this implementation, a channel leading from an interior intake port 116 may facilitate movement of sheared solids toward inside portion of the wall 522. In one implementation, one or more or the channels may terminate at a perimeter intake port 114. In this way, for example, solids that are translated along a channel 528 toward the perimeter intake port 114 may be subjected to the radial shearing action of the radial cutting edge 524 combined with the terminal end of a rotating cutting arm. In one implementation, a direction, length and design of the respective channels 528 may be determined based on use conditions of the cutter/grinder system 100, for example, a speed of the rotating arms, size of solids, expected head pressure, pipe diameters, fluid characteristics, and other conditions.

In one implementation, the example stationary cutter 102 can comprise one or more sub-planar cut-outs 530, disposed on an intake side of the perimeter wall 106. In this implementation, the respective sub-planar cut-outs 530 may be configured to mitigate clogging of the cutter/grinder system 100, and/or to improve flow of a fluid comprising solids through the intake ports 114, 116. Further, in one implementation, the location and size of the sub-planar cut-outs 530 may provide improved solids shearing/grinding action results. As an example, a size, location, number and depth of a sub-planar cut-outs 530 may vary, depending on the expected application (amount and type of solids, type of fluid, pipe size, head pressure, etc.). In one implementation, as illustrated in FIGS. 5-7, a sub-planar cut-out 530 may be disposed at a location of one or more perimeter intake ports 114, on the intake side of the perimeter wall.

With continued reference to FIGS. 1-7, FIGS. 8-12 are component diagrams illustrating various views of a portion of the cutter/grinder system 100, as described herein. In this implementation, the movable cutter 104 can comprise keyway 832 that is configured to selectably engage with a corresponding key coupled with the shaft of a pump. As an example, the shaft of a pump may comprise a key that is configured (e.g., in shape and size) to slidably engage with the keyway 832 at the cutter hub 112. In this way, in this example, a rotation of the shaft may result in a rotation of the movable cutter, such as during pump operation.

In one implementation, the movable cutter 104 can comprise a first cutting edge 834, comprising an axial cutter (e.g., a leading cutting edge), disposed on one or more of the cutter arms 110. The first cutting edge 834 can be configured to engage with solid matter, for example, in combination with the base axial cutting edge 526, in order to reduce the size of the solid matter. As an example, in combination with the base intake port cutting edge 526, the first cutting edge 834 of the cutter arm 110, can provide a shearing, scissor-like cutting action on solid material that may be drawn to the intake port 116 of the base plate 108 of the stationary cutter 102. That is, for example, the pump may draw the fluid comprising the solid matter toward its intake area, and at least a portion of the solids may enter one or more of the interior intake ports 116 of the base plate 108. In this example, the first cutting edge 834 can create a cutting or shearing action with the base intake port cutting edge 526 to cut, chop, and/or grind the solid matter into a smaller size so that it can more easily enter the interior intake ports 116 and be less likely to create clogging issues for the pump.

In one implementation, the first cutting edge 834 can comprise serrations 838. As an example, a serrated cutting edge can comprise a plurality of smaller points of contact with the solid matter subjected to the shearing action. For example, having a smaller contact area at any one time, than a straight edge, allows the applied pressure at each point of contact to impart a greater force to the subject matter. Further, the curved nature of the serrated edges 838 can provide a sharper angle to the material being cut. This may result in an improved shearing action in conjunction with the curved shaped of the base intake port cutting edge 526, for example, particularly as the cutter arm 110 rotates around the base plate 108. That is, for example, as the cutter arm 110 rotates, a first portion of a serration 838 may contact a solid engaged with the base intake port 116. In this example, as the cutter arm continues to rotate, the different portions of the serration 838 contact the solid at different angles. Additionally, as the cutter arm 110 rotates, the serration 838 can traverse the base intake port 116, providing improved shearing action in conjunction with the base intake port cutting edge 526. This type of action may improve cutting/grinding performance of the example grinder/cutter assembly 100.

In one implementation, the movable cutter 104 can comprise a second cutting edge 836, comprising a radial cutter, disposed on a distal end of one or more of the cutter arms 110. The second cutting edge 836 can be configured to engage with solid matter, for example, in combination with the wall intake port cutting edge 524 (e.g., base radial cutting edge), in order to reduce the size of the solid matter. As an example, in combination with wall intake port cutting edge 524, the second (e.g., radial) cutting edge 836 of the cutter arm 110, can provide a shearing, scissor-like cutting action on solid material that may be drawn to the perimeter intake port 114 of the base plate 108 (e.g., and wall 106) of the stationary cutter 102. That is, for example, the pump may draw the fluid comprising the solid matter toward its intake area and at least a portion of the solids may enter one or more of the perimeter intake ports 114 of the base plate 108, or be translated toward them by the rotating action of the cutter arms 110. In this example, the second cutting edge 836 can create a shearing action with the wall intake port cutting edge 524 to cut, chop, and/or grind the solid matter into a smaller size so that it can more easily enter the perimeter intake ports 114 and be less likely to create clogging issues for the pump.

In one or more implementations, the second (e.g., radial) cutting edge 836 can comprise varying sizes, and/or shapes; and may be disposed on one or more of the cutting arms 110. As an illustrative example, as illustrated in FIGS. 8-12, a second cutting edge 836 may comprise a first size and shape 836*a* (e.g., long and narrow), a second size and shape 836*b* (e.g., medium length and thick), and a size length and shape 836*c* (e.g., short and medium width) (e.g., and a fourth, etc.). Further, in one implementation, the second cutting edge 836 can be disposed at various portions of the distal end of the cutter arm 110, and/or at different cutting angles, as illustrated. For example, a radial cutting edge can comprise a first cutting angles, and a second, different cutting angle (e.g., and a third, and a fourth, etc.). In this way, in this example, engaged solids may be operated upon from different angles to provide a more effective cutting/shearing action.

Figure 9:
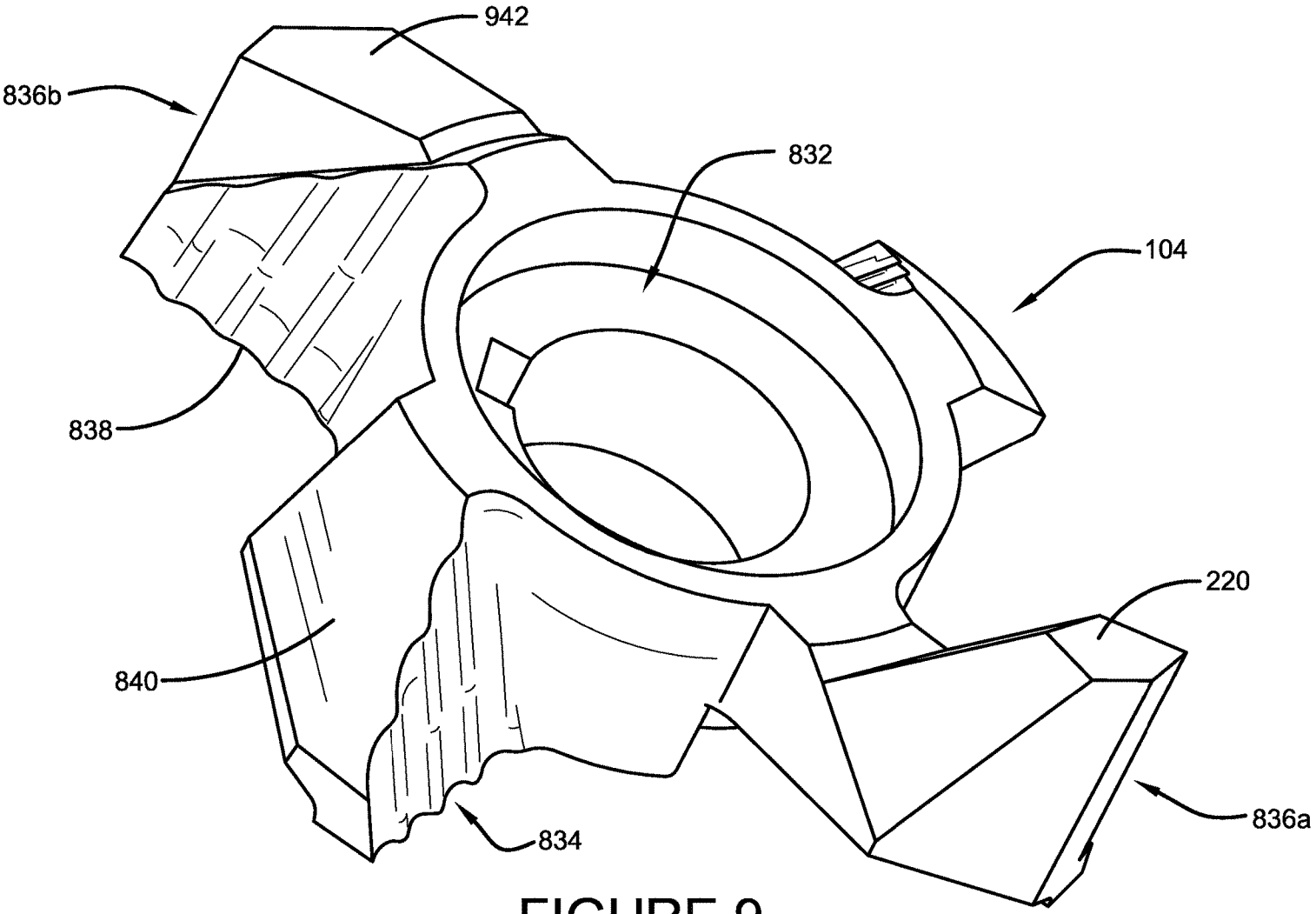
FIG. 9 is a component diagram illustrating a top perspective view of an example implementation of one or more portions of one or more components described herein.
Figure 12:
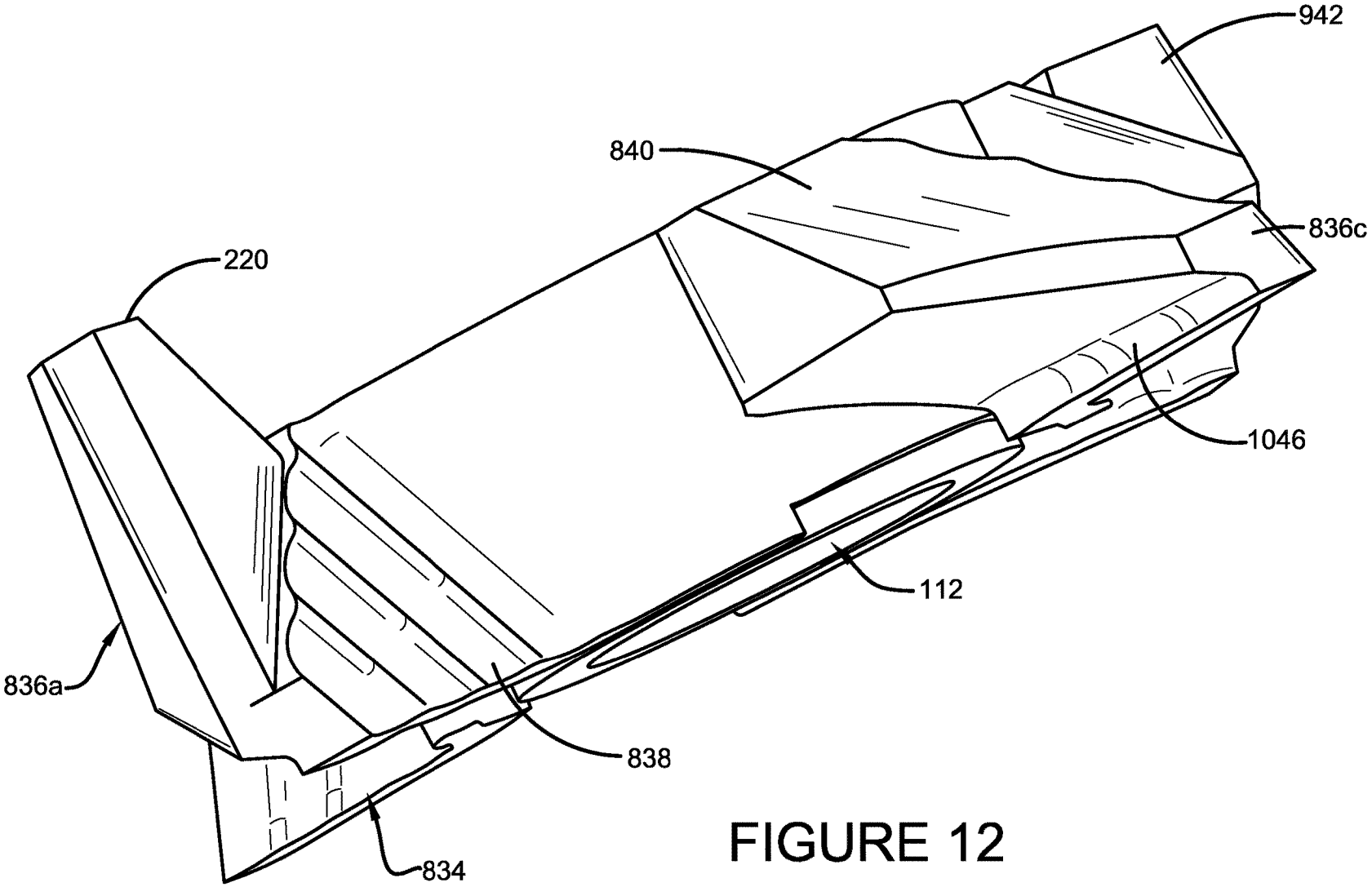
FIG. 12 is a component diagram illustrating a side view of an example implementation of one or more portions of one or more components described herein.

As an illustrative example, as illustrated in FIG. 12, second cutting edge 836*a* is disposed such that a top portion of the second cutting edge 836*a* can interact with higher portions of the perimeter wall 106 (e.g., and therefore higher portions of a wall cutting edge 524). In this example, a second cutting edge 836*c* is disposed at a lower position on the distal end of the cutter arm 110 (e.g., and at a different cutting angle), which may allow it to interact with lower portions of the perimeter wall 106 (e.g., and therefore lower portions of a wall cutting edge 524). Additionally, a second cutting edge 836*b*, in FIG. 9, is disposed at a middle position on the distal end of the cutter arm 110, which may allow it to interact with middle portions of the perimeter wall 106. In this way, for example, having varied second cutting edge 836 positions may provide for a more effective cutting/grinding of solid matter, such as by impacting the matter at various locations (e.g., and at different cutting angles) during movable cutter 104 rotation.

Figure 10:
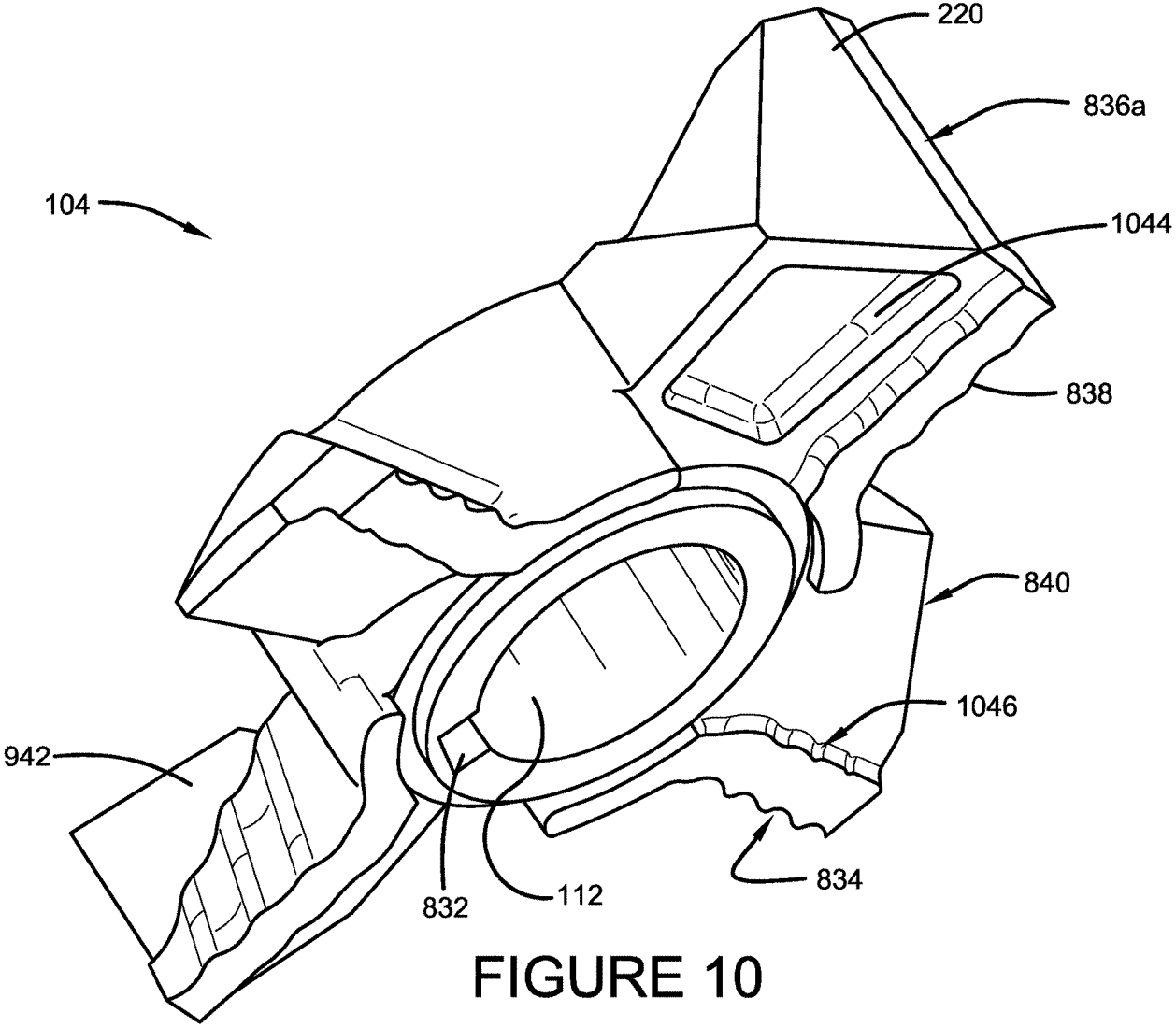
FIG. 10 is a component diagram illustrating a bottom perspective view of an example implementation of one or more portions of one or more components described herein.
Figure 11:
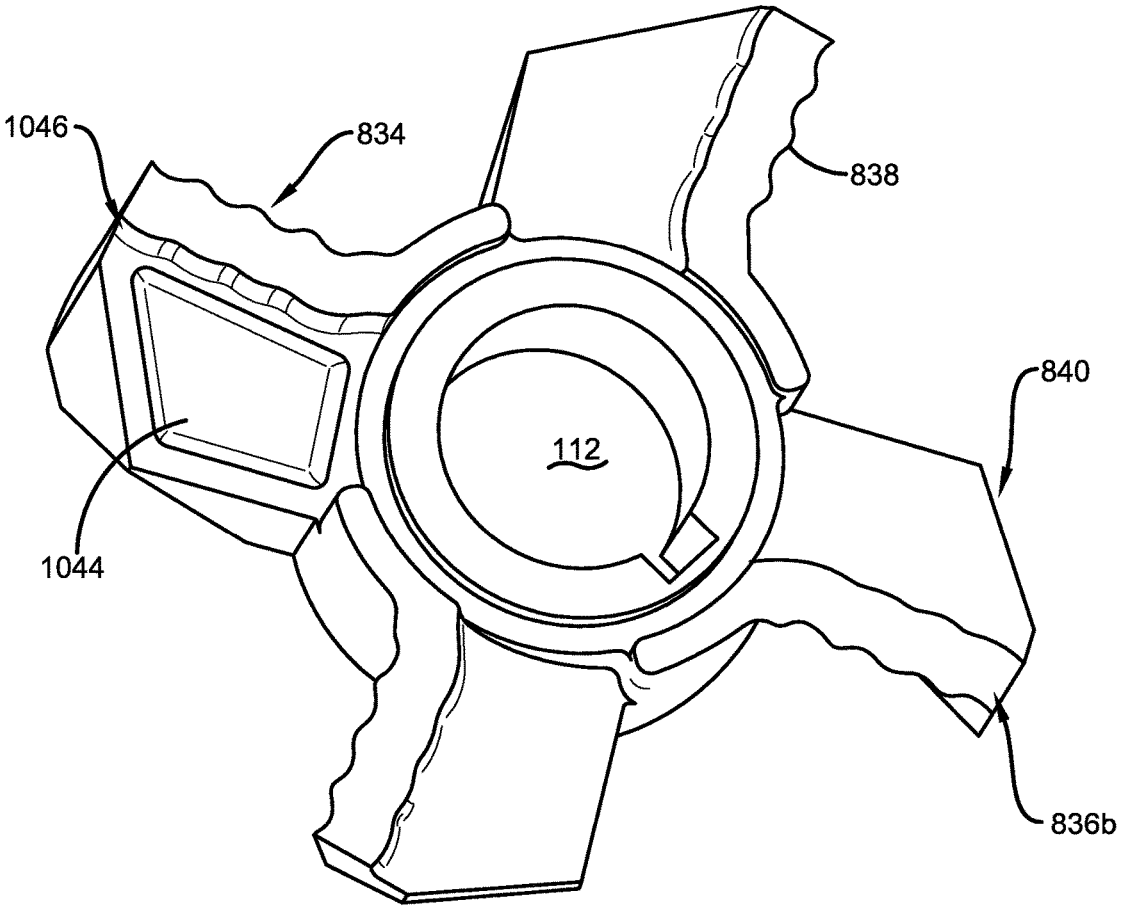
FIG. 11 is a component diagram illustrating a bottom view of an example implementation of one or more portions of one or more components described herein.

As illustrated in FIGS. 8-12, in one implementation, a cutter arm 110 of the movable cutter 104 can comprise a trailing edge 840 and a relief portion of the trailing edge 1046 (e.g., in FIGS. 10 and 11). A shape, size and/or angle of disposition of the trailing edge 840 can be configured to mitigate a cavitation effect that may result from the movable cutter 104 rotating through a fluid. Further, in one implementation, the relief portion of the trailing edge 1046 may also be configured to mitigate a cavitation effect. That is, for example, a lower pressure may form behind the cutter arm 110 as it moves through the fluid (e.g., at the trailing side of the cutter arm). In this example, the lower pressure can allow fluid cavitation to occur, which may result in damage to the material (e.g., metal) forming the cutter arm 110. In this implementation, a transition with a fillet, comprising a desired size, transition angle, and/or shape, can help mitigate separation of the fluid, thereby mitigating creation of a vacuum behind the cutter arm 110. The size of the relief portion of the trailing edge 1046 may also facilitate in reducing the separation of fluid.

Additionally, the relief portion of the trailing edge 1046 can be configured to reduce potential contact area between the axial cutter edge 834 of the cutter arm 110 and the base plate 108. As an example, clearances between the axial cutter edge 834 and the base plate 108 can be reduced to accommodate a desired solids reduction performance level. In this example, the relief portion of the trailing edge 1046 can facilitate in creating a reduced axial cutter edge 834 footprint, which may come into contact with the surface of the base plate 108 during operation. In this way, for example, a reduction in potential friction may result, allowing the cutter/grinder assembly 100 to perform more efficiently on a pump. Further, the relief portion of the trailing edge 1046 can be used to reduce the amount of material used to manufacture the movable cutter 104, for example, making it easier to manufacture, lighter, and more efficient.

As illustrated in FIGS. 2, 8, 9 and 12, in one implementation, the movable cutter 104 can comprise a slinger component 220. A slinger 220 can be disposed on one or more cutter arms 110, at the distal portion. The slinger 220 can be configured to engage with larger solids, and/or flexible solids (e.g., cloth, cloth-like material, plastics, string, etc.) and transition them away from the path of the inlet. As an example, larger solids and flexible solids can cause clogs in the cutter assembly 100 and/or may wrap around the movable cutter 104, reducing the ability of the cutter assembly 100 to perform appropriately. In one example, the slinger 220 can catch flexible solids and sling them away from the intake area of the pump, before they become entangled with the cutter assembly 100. In this way, portions of these type of solids may be moved away from the cutter assembly continually, for example, until they have been reduced in size to a point where they may be drawn though the intake ports 114, 116.

As illustrated in FIGS. 9, 10 and 12, in one implementation, the movable cutter 104 can comprise a weighting component 942. Further, in one implementation, as illustrated in FIGS. 10 and 11, the movable cutter 104 can comprise a cutout portion 1044. The weighting component 942 and/or the cutout portion 1044 may be configured to facilitate weight distribution for the movable cutter 104. As an example, a slinger 220 disposed at the distal end of a cutter arm 110 may result in weight displacement of the movable cutter 104 distributed outward from the hub area 112 toward the location of the slinger 220. In this example, a weight distribution that extends out from the hub area 112 may result in an undesirable operation, such as wobbling during rotation, and/or additional forces causing stress on the portions of the cutter subjected to the additional weight (e.g., the cutter arm 110 comprising the slinger 220). That is, for example, having the center of weight distribution as close the center of the hub area 112 as achievable can provide for smoother operation of the movable cutter 104. In this example, this distribution can result in mitigated chances of damage to portions of the movable cutter 104 through additional stresses. Further, the distribution may provide for prolonged life for a bearing associated with the shaft of the pump, and can generally increase the mean time between repairs on the system, and/or pump.

In one implementation, the cutout portion 1044 can be disposed on a bottom portion of the distal portion of the cutter arm 110 on which the slinger 220 is disposed. As illustrated in FIGS. 10 and 11, the cutout portion 1044 may be sized and/or shaped in accordance with sound engineering practices to accommodate the desired weight distribution for the intended uses of the movable cutter 104. That is, for example, an amount of material removed from the cutter arm 110 by the cutout portion 1044 may provide a reduction in weight on the cutter arm 110 on which the slinger 220 is disposed. Further, as illustrated in FIGS. 9, 10 and 12, the weighting component 942 can be disposed on a cutter arm 110 that is radially opposed to the cutter arm on which the slinger 220 is disposed. That is, for example, the additional material provided by the weighting component 942 may transition the center of weight distribution toward the hub area 112, thereby counteracting the additional weight provided by the slinger 220 to the distal end of the cutter arm 110.

Figure 13:
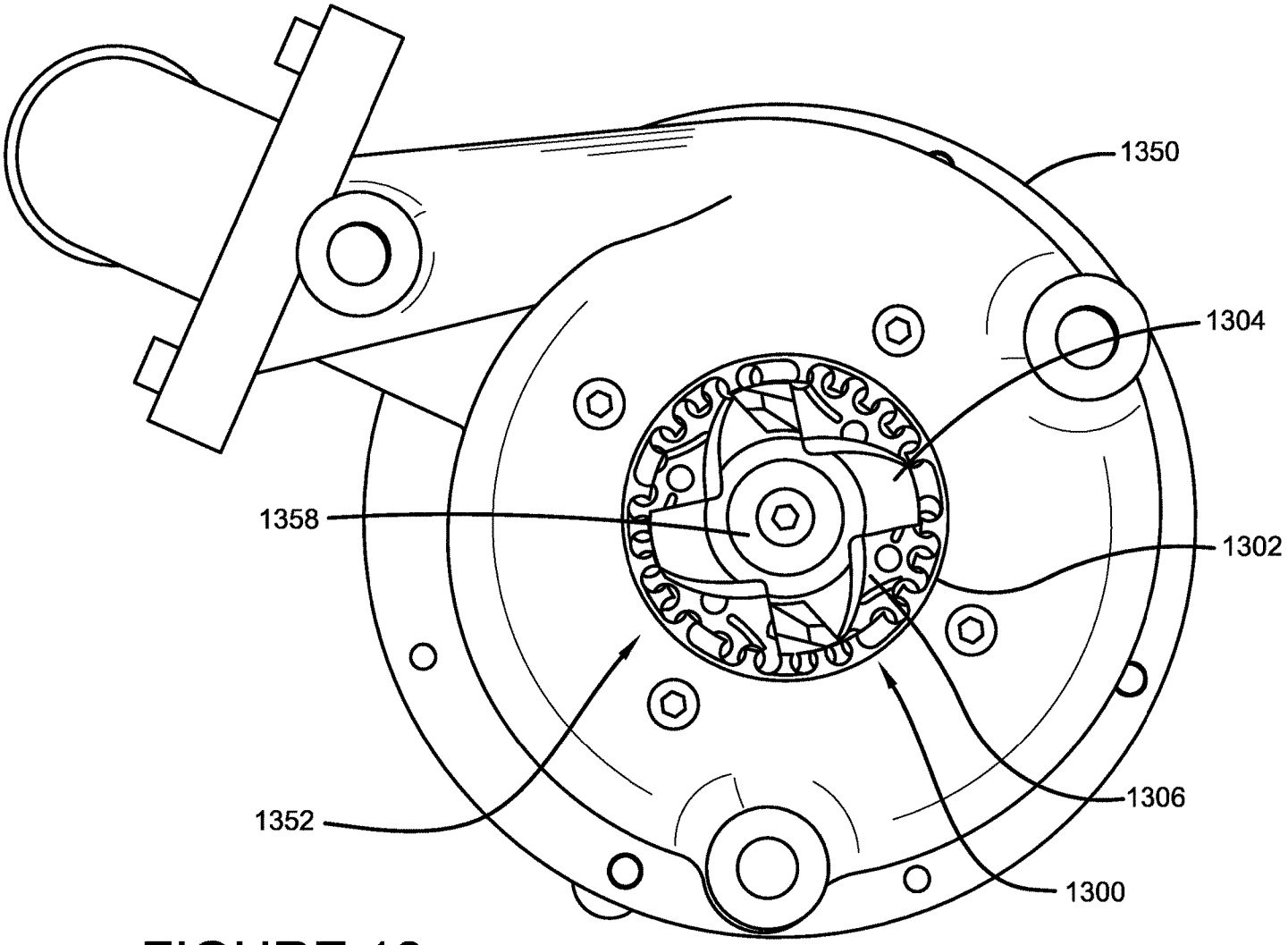
FIG. 13 is a component diagram illustrating a bottom view of an example environment where one of more portions of one or more components described herein may be implemented.
Figure 14:
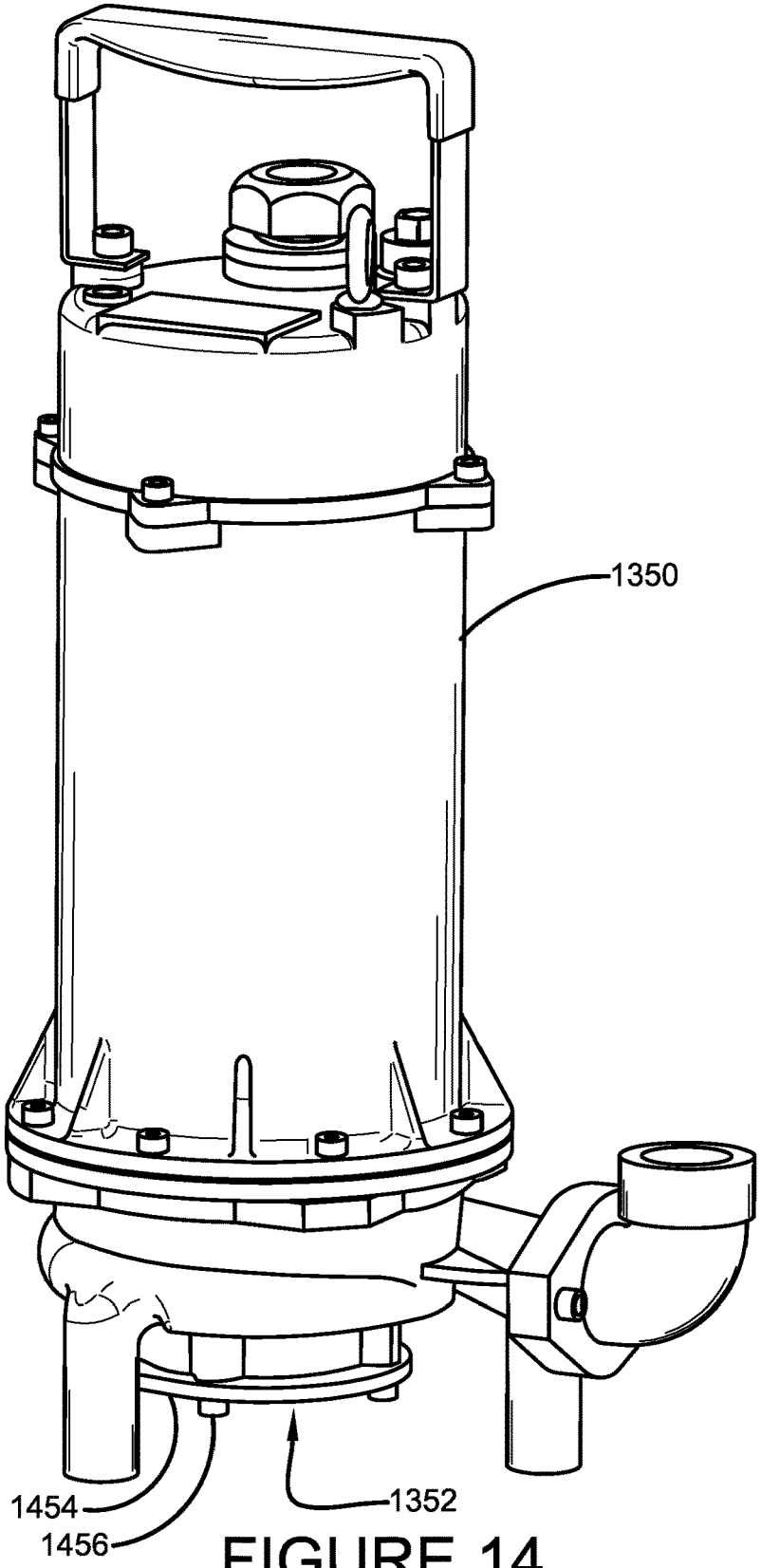
FIG. 14 is a component diagram illustrating an example environment where one of more portions of one or more components described herein may be implemented.
Figure 15:
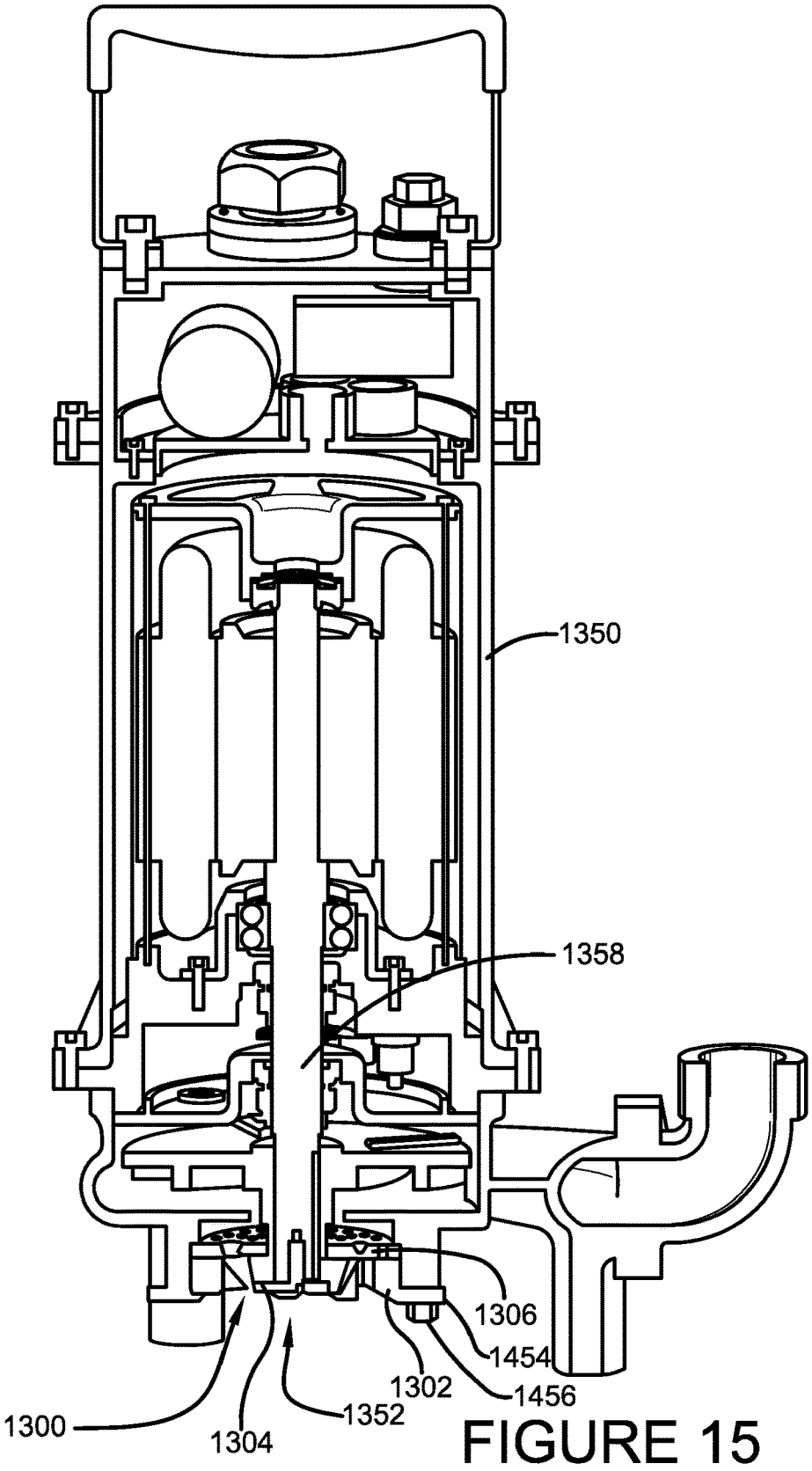
FIG. 15 is a component diagram illustrating a cut-away view of an example environment where one of more portions of one or more components described herein may be implemented.

FIGS. 13-15 illustrate an example environment where one or more portion of one or more systems, described herein, may be implemented. FIGS. 13-15 are illustrative examples of an alternate implementation of a cutter assembly 1300 (e.g., similar to cutter assembly 100 of FIGS. 1-4) operably engaged with an exemplary pump 1350. As described above, the exemplary pump 1350 may comprise a wastewater pump that is configured to pump wastewater from a first location to a second location, such as from a residential or commercial wastewater system to a municipal waste collection system. In this example, the exemplary pump 1350 can comprise an intake area 1352 that is configured to receive fluid to be pumped, and that may pass through the alternate cutter assembly 1300. As an example, the intake area 1352 may comprise a cavity that facilitates creation of an area of lower pressure while the pump is in operation, which can cause fluids to be drawn toward the intake area 1352. Further, the intake area may be sized such that a desired fluid head pressure can be maintained during pumping, in association with expected fluid line elevation change, length and size.

In this implementation, the alternate cutter assembly 1300 can be operably coupled with the pump 1350 in the intake area. The alternate cutter assembly 1300 can comprise an alternate stationary wall cutter 1302 (e.g., similar to perimeter wall 106 of FIGS. 1-7), which may be sized in accordance with expected use conditions. That is, for example, the alternate stationary wall cutter 1302 can project transversely from the bottom wall of the pump 1350 into the intake area 1352. The height of the alternate stationary wall cutter 1302 may be determined by the size of the intake area, and/or related to and expected head pressure versus flow curve for the pump's intended use. Further, the alternate cutter assembly 1300 can comprise an alternate stationary base cutter plate 1306 (e.g., similar to base plate 108 of FIGS. 1, 5 and 7). Additionally, the alternate cutter assembly 1300 can comprise an alternate movable cutter 1304 (e.g., similar to 104 of FIGS. 1-3 and 8-10).

Figure 16:
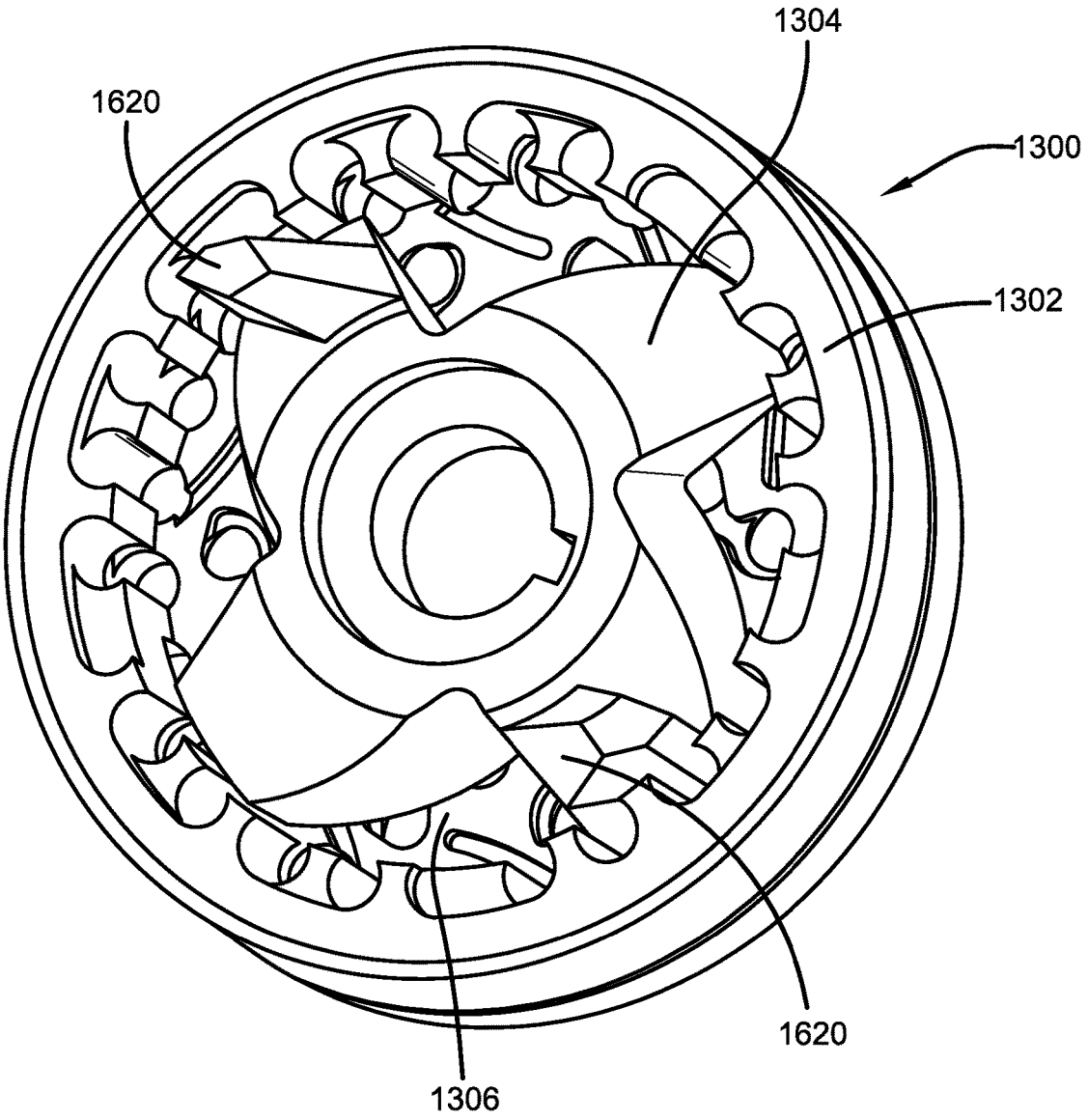
FIG. 16 is a component diagram illustrating an example implementation of an alternate hybrid axial radial cutter assembly.
Figure 17:
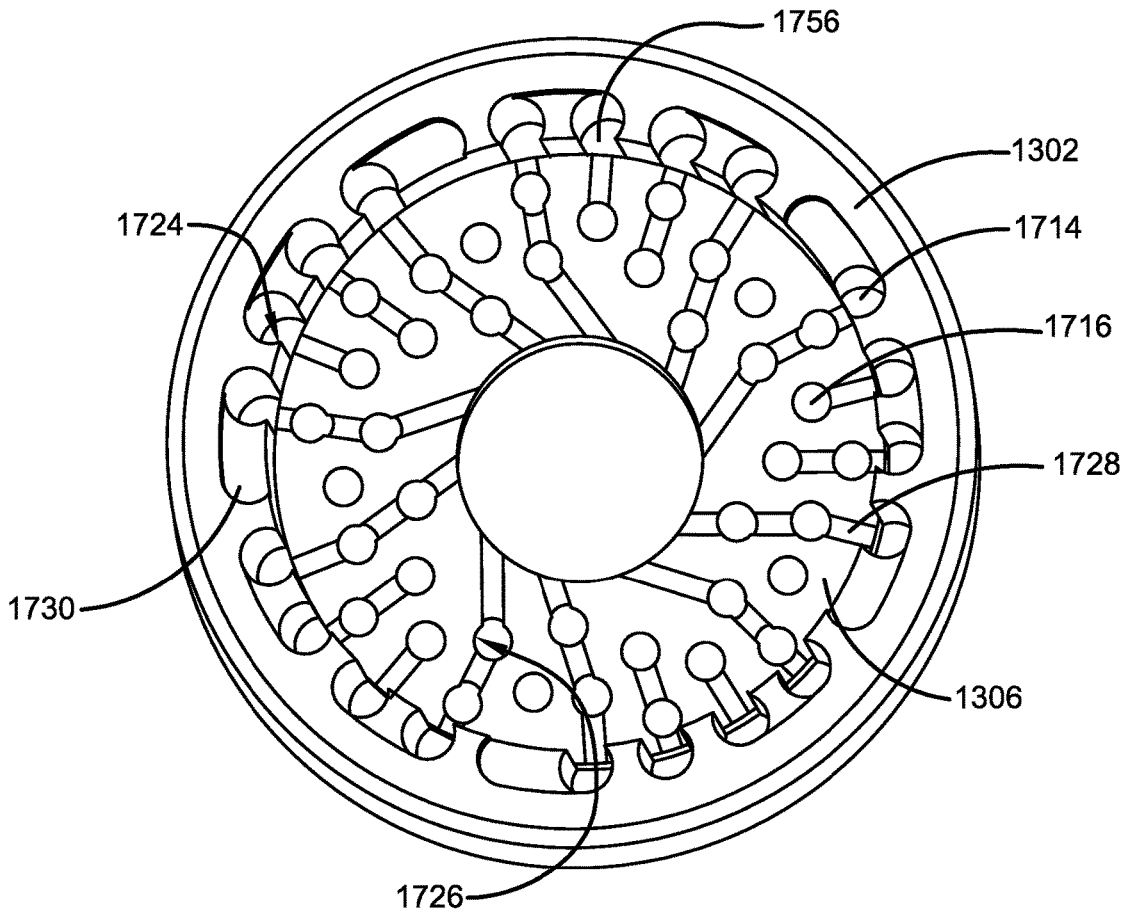
FIG. 17 is a component diagram illustrating an example implementation of one or more portions of one or more components described herein.

FIGS. 16-21 illustrate one or more portions of one or more components for an alternate cutter assembly 1300. In this implementation, as illustrated in FIG. 16, the alternate cutter assembly 1300 can comprise the alternate stationary wall cutter 1302, the alternate stationary base cutter plate 1306, and the alternate movable cutter 1304. For example, much like the cutter assembly 100 of FIGS. 1-4, the alternate movable cutter 1304 can be operably coupled with a shaft of a pump, resulting in rotation of the alternate movable cutter 1304 within a stationary cutter formed by the alternate stationary wall cutter 1302, the alternate stationary base cutter plate 1306, which can be non-movably engaged with the pump (e.g., force fit, fastened, threaded, etc.).

As illustrated in FIGS. 17-21, the stationary cutter can comprise a separate alternate stationary wall cutter 1302 component and an alternate stationary base cutter plate 1306 component. In one implementation, these components can be non-movably engaged with each other, and/or with the pump, such as by a force fitting, fastening means, or other non-movable engagement. The alternate stationary wall cutter 1302 can comprise a plurality of alternate wall intake ports 1714 (e.g., similar to perimeter intake ports 114 of FIGS. 1-7), which can respectively comprise an alternate wall cutting edge 1724 (e.g., similar to cutting edge of wall intake ports 524 of FIGS. 5-7). Further, the alternate stationary wall cutter 1302 can comprise one or more alternate sub-planar depressions (e.g., similar to sub-planar cutouts 530 of FIGS. 5 and 7).

Figure 21:
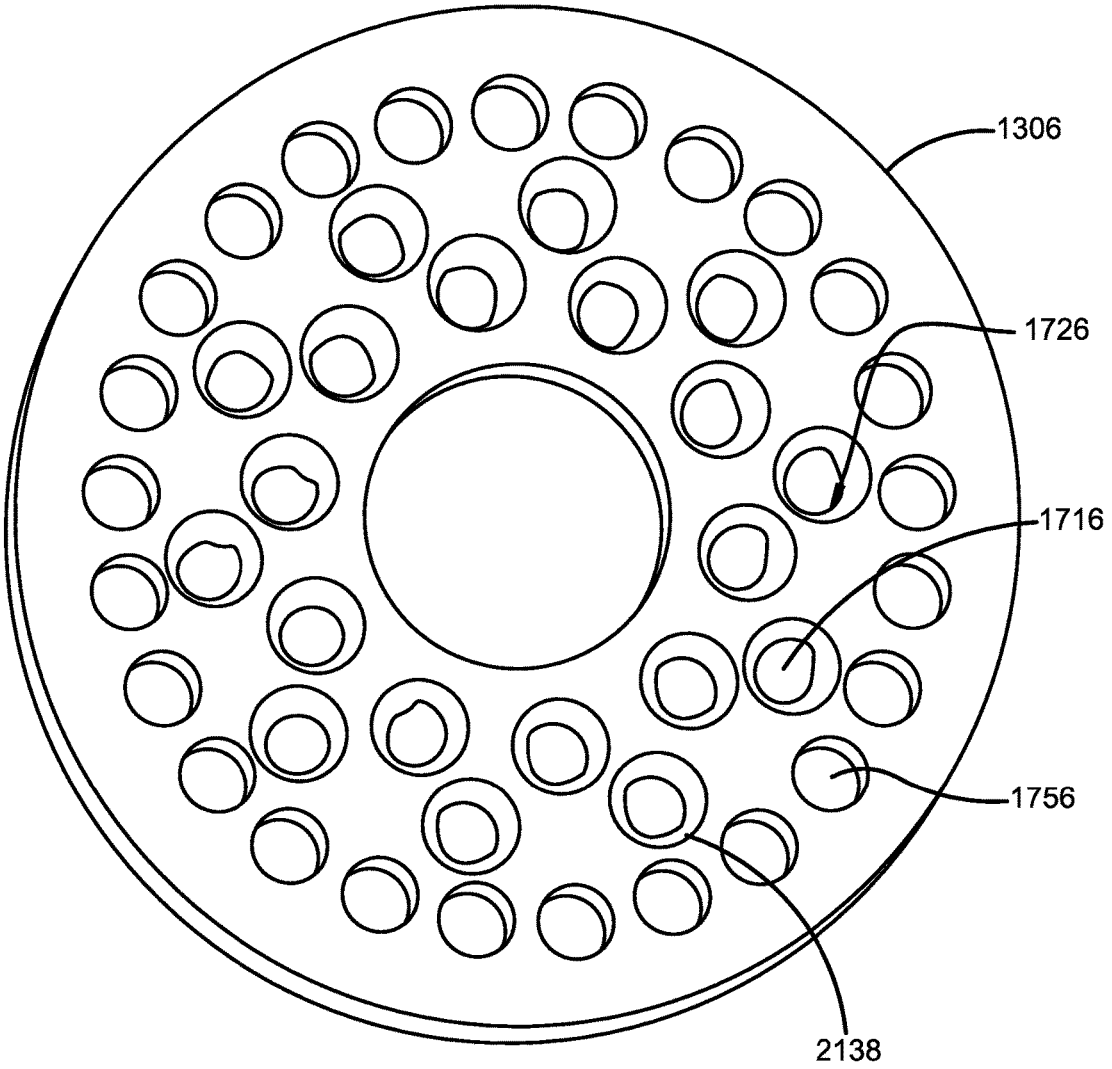
FIG. 21 is a component diagram illustrating an example implementation of one or more portions of one or more components described herein.
Figure 22A:
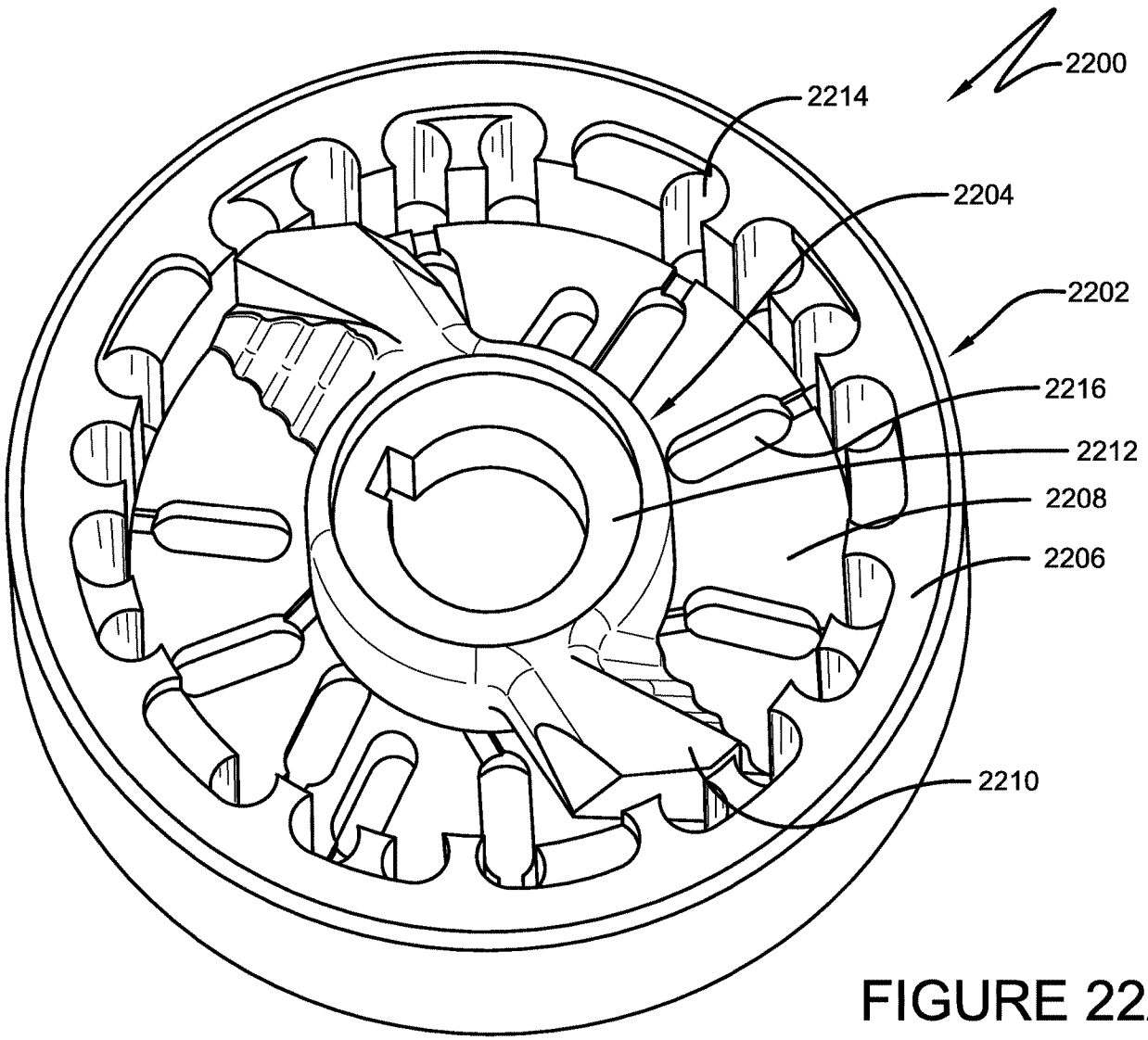
FIGS. 22A and 22B are component diagrams illustrating various views of an example implementation of an exemplary alternate hybrid axial radial cutter assembly.
Figure 22B:
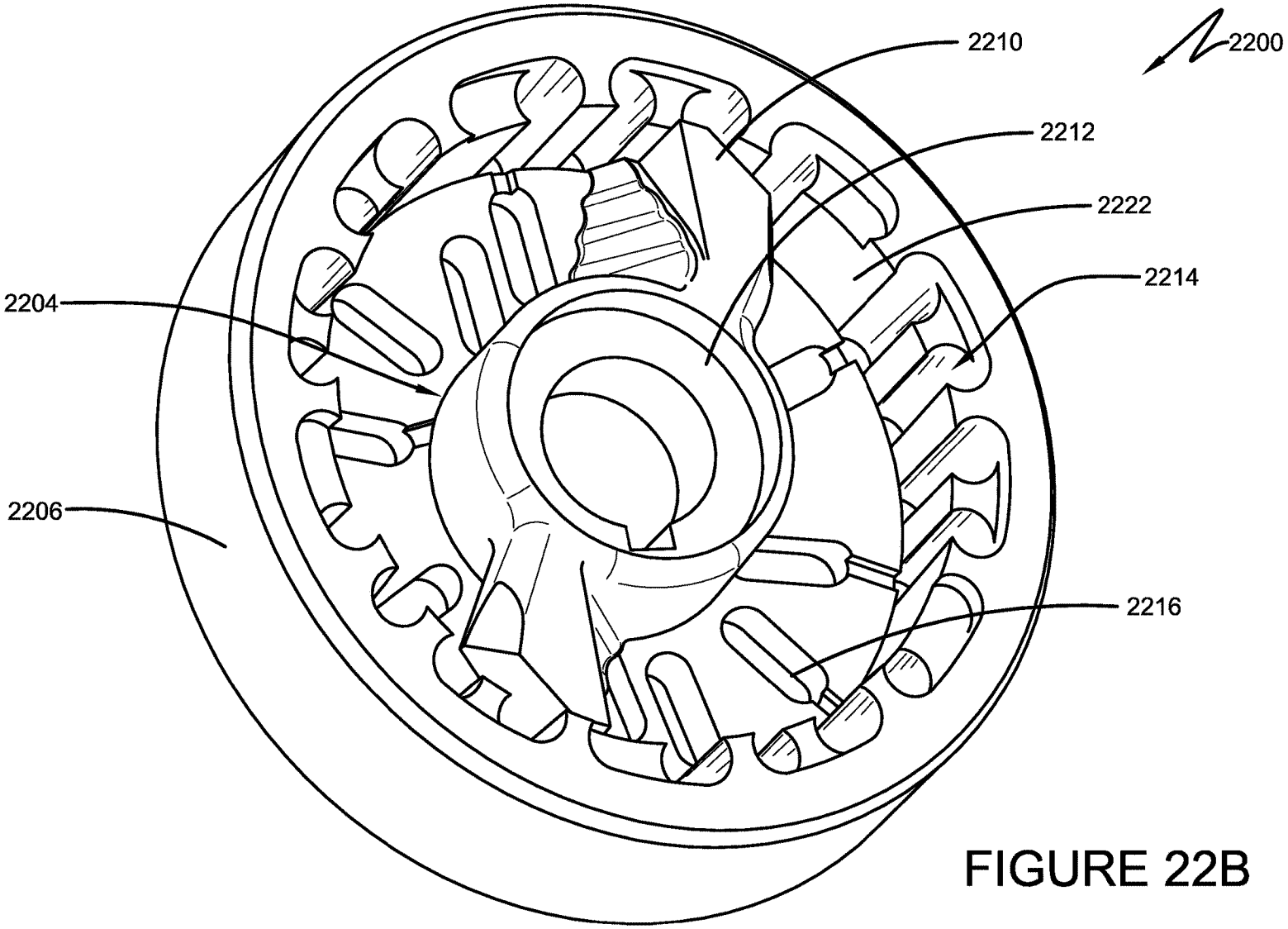

The alternate stationary base cutter plate 1306 can comprise a plurality of alternate interior plate intake ports 1716 (e.g., similar to interior intake ports 116 of FIGS. 1 and 3-7), which can respectively comprise an alternate base cutting edge 1726 (e.g., similar to cutting edge of base intake ports 526 of FIGS. 5-7). In one implementation, as illustrated in FIG. 21, respective interior plate intake ports 1716 can comprise a frustoconical shape 2138, for example, where the port opening forms a frustum. As described above, this shape may provide a sharper cutting angel for the alternate base cutting edge 1726. In one implementation, the base cutter plate 1306 can comprise a base cutter extension (not pictured), which can be associated with the one or more alternate interior plate intake ports 1716. The base cutter extension can be configured to provide an extended cutting channel that may collect and force solids into the associated interior plate intake port 1716. For example, the base cutter extension can be sized and shaped to facilitate solids collection, and can provide a larger cutting edge (e.g., than the alternate base cutting edge 1726 alone) for the shearing action provided by an alternate cutter arm 1734. Further, the base cutter plate 1306 can comprise a plurality of perimeter base ports that are respectively configured to align with a corresponding alternate wall intake port 1714. Additionally, the base cutter plate 1306 can comprise one or more alternate channels 1728 (e.g., similar to channels 528 of FIGS. 5-7).

Figure 18:
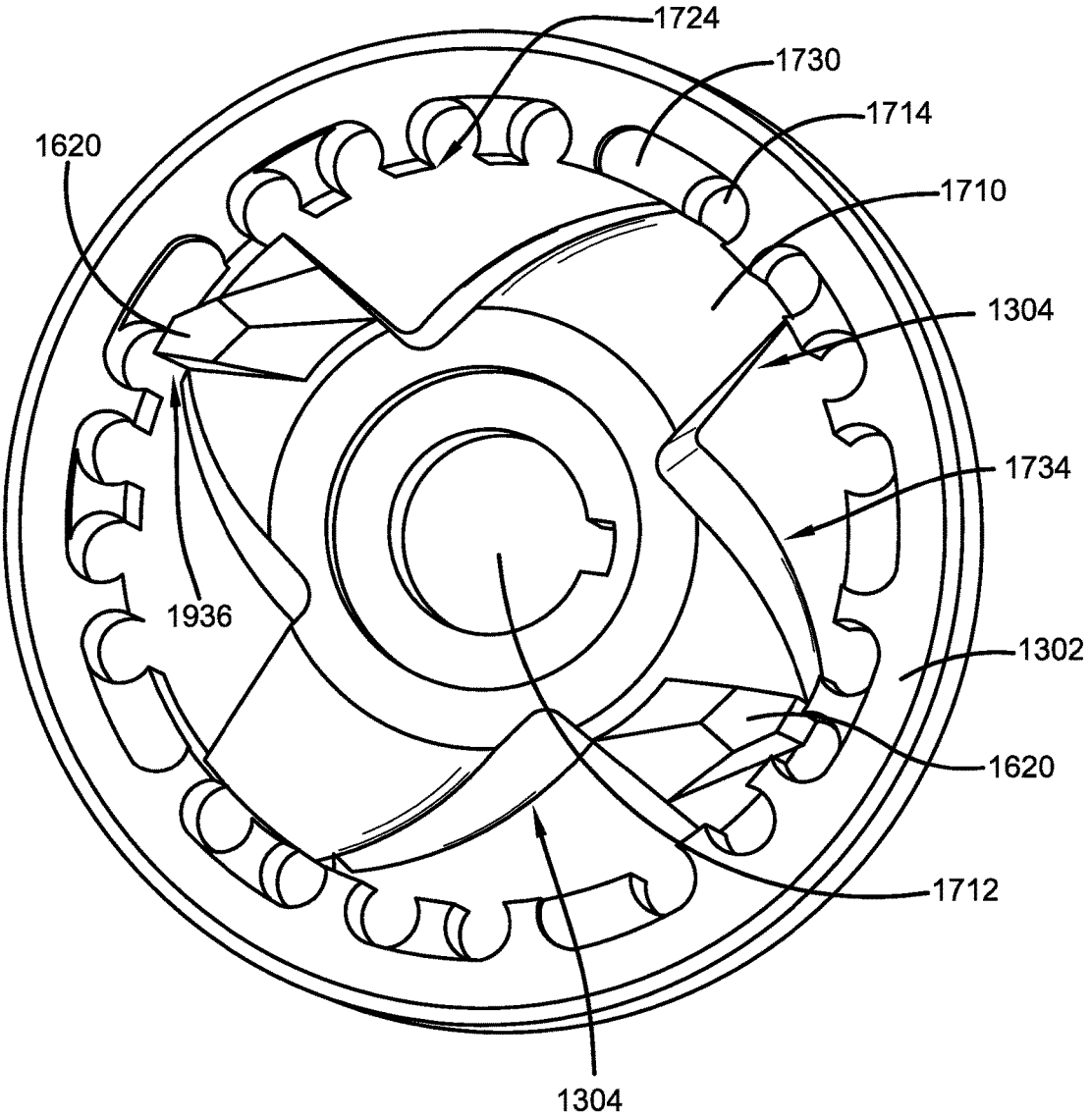
FIG. 18 is a component diagram illustrating an example implementation of one or more portions of one or more components described herein.
Figure 19:
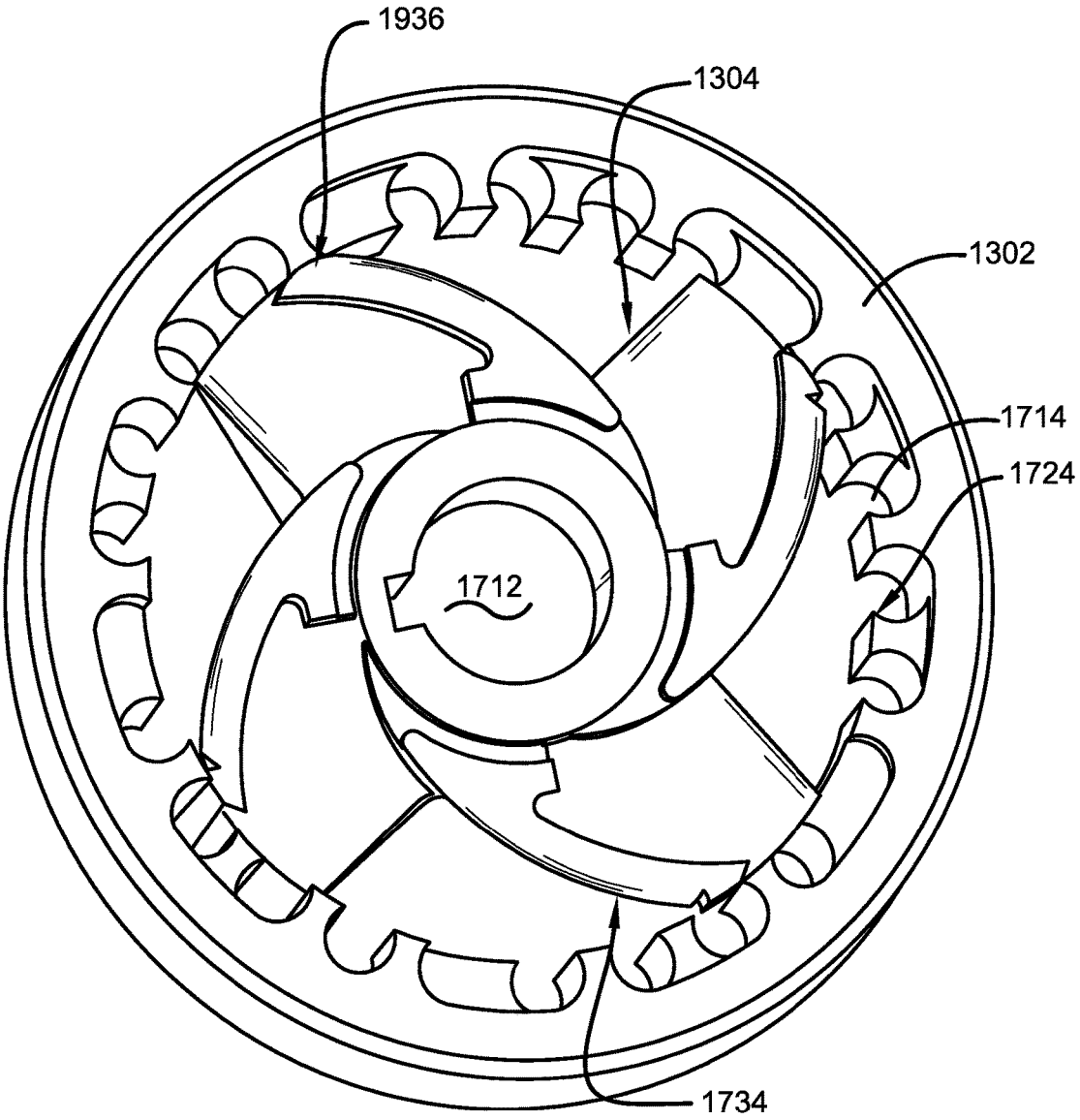
FIG. 19 is a component diagram illustrating an example implementation of one or more portions of one or more components described herein.
Figure 20:
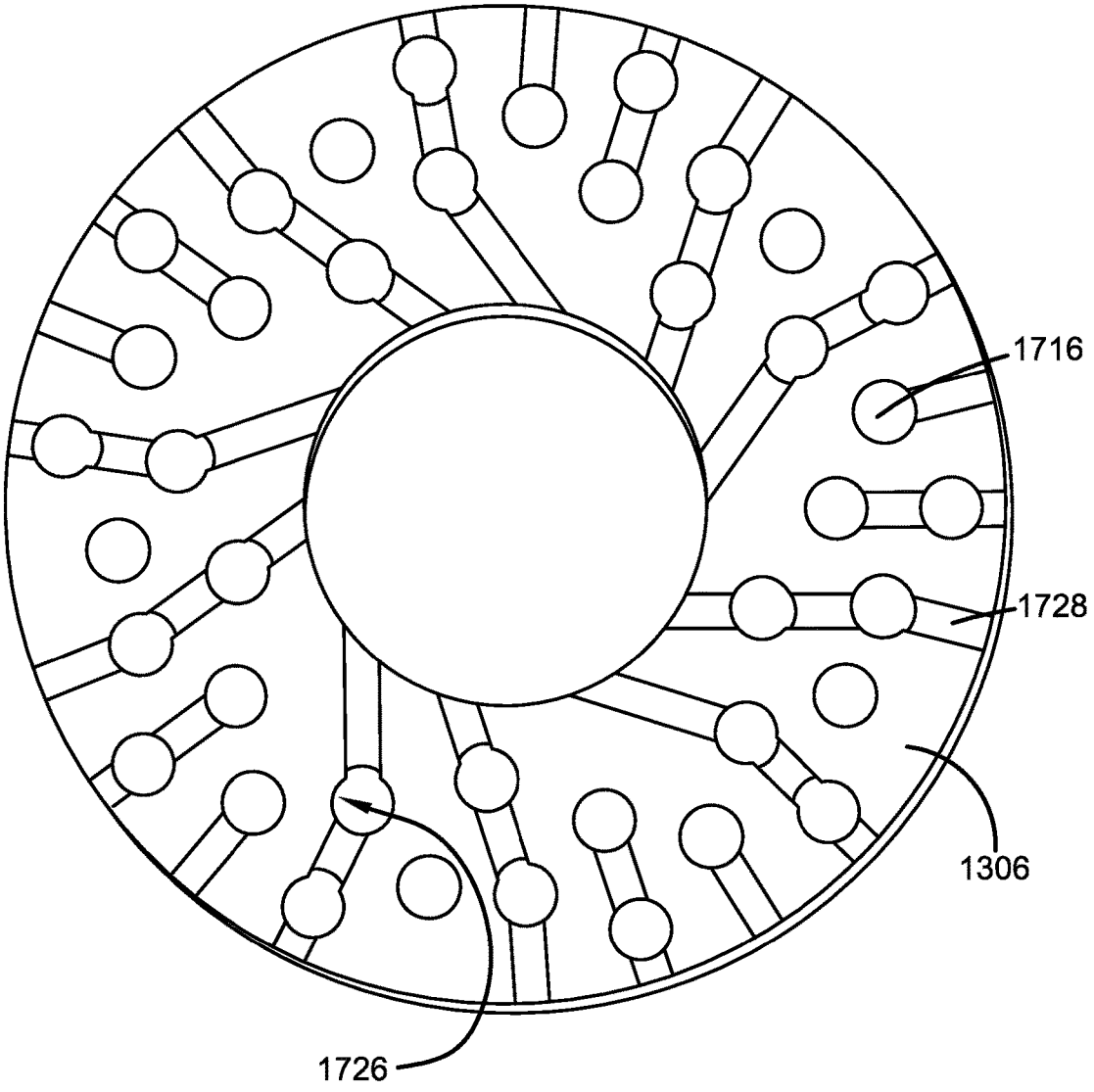
FIG. 20 is a component diagram illustrating an example implementation of one or more portions of one or more components described herein.

As illustrated in FIGS. 16, 18 and 19, the alternate movable cutter 1304 can comprise the alternate hub area 1712, which can be configured to receive (e.g., and engage with) at least a portion of the pump shaft. The alternate movable cutter 1304 can comprise one or more alternate cutter arms 1710 (e.g., similar to cutter arm 110 FIGS. 1, 3, 4, and 8), respectively comprising an alternate axial cutter edge (e.g., similar to the first cutting edge 834 FIGS. 8-12). Further, the alternate movable cutter 1304 can comprise an alternate radial cutter edge (e.g., similar to the second cutting edge 836 FIGS. 8-12). Additionally, the alternate movable cutter 1304 can comprise one or more alternate slinger components 1620. In one implementation, an example, movable cutter 1304 can comprise at least two alternate slingers 1620, respectively disposed on a distal portion of alternate cutter arms 1710, where the respective cutter arms 1710 are disposed in a same axis passing through the hub area 1712. In this way, for example, the weight distribution may not be substantially affected, as substantially a same amount of weight may be added to the respective cutter arms 1710, on a same axis.

FIGS. 22A, 22B, 23A, 23B, 23C, 24A, 24B, and 24C are component diagrams illustrating an exemplary alternate cutter/grinder assembly 2200 that can be used in a fluids pump system. In this implementation, the example assembly 2200 comprises a stationary cutter base 2202 and a rotating cutter 2204. The stationary cutter base 2202 comprises a stationary cutter plate 2208 and a stationary cutter wall 2206. The stationary cutter plate 2208 is configured to operably couple with an intake area of a pump (e.g., 1352 of pump 1350 in FIG. 13), such as by using a retaining ring (e.g., 1454 of FIG. 14) and fasteners (e.g., 1456 of FIG. 14), for example. In this implementation, the stationary cutter plate 2208 can comprise a plurality of intake ports, comprising a first set of plate intake ports 2214 and a second set of plate intake ports 2216. In the implementation, the first set of plate intake ports 2214 may be disposed around a perimeter portion of the stationary cutter plate 2208. Further, the second set of plate intake ports 2216 may be disposed in an interior portion of the stationary cutter plate 2208.

In this implementation, in the example assembly 2200, the stationary cutter wall 2206 can be fixedly engaged (e.g., fastened, welded, bonded, integrally formed, etc.) with the stationary cutter plate 2208, where the wall 2206 is projecting in a substantially transverse direction from the perimeter of an intake side (e.g., 1352) of the stationary cutter plate 2208. In this implementation, the stationary cutter wall 2206 can comprise a wall intake port (e.g., a radial intake port) disposed in substantial alignment with the respective first set of plate intake ports 2214. Additionally, one or more of the respective wall intake ports can comprise a wall cutting edge 2324 (e.g., radial cutting edge).

In the example assembly 2200, with reference to FIGS. 13-15, a rotating cutter 2204 can be configured to engage with a rotating shaft 1358 of the pump 1350, for example, such that rotation of the shaft 1358 can result in rotation of the rotating cutter 2204. In one implementation, the rotating cutter can comprise a cutter hub 2212 that is configured to selectably engage with the shaft of a pump, for example, for removal and replacement of the cutter 2204 in a pump (e.g., 1350). In one implementation, the movable cutter 104 can comprise keyway 2432 that is configured to selectably engage with a corresponding key coupled with the shaft 1358 of the pump 1350. As an example, the shaft 1358 of a pump 1350 may comprise a key that is configured (e.g., in shape and size) to slidably engage with the keyway 1358 at the cutter hub 2212. In this way, in this example, a rotation of the shaft may result in a rotation of the movable cutter, such as during pump operation.

The rotating cutter 2204 can comprises a plurality of cutting arms 2210 (e.g., two or more) that project radially from a central hub portion 2212 of the rotating cutter 2204. The respective cutting arms 2210 can comprise an axial cutting edge 2434 (e.g., first cutting edge) and a radial cutting edge 2436 (e.g., second cutting edge). In one implementation, the axial cutting edge 2434 can be disposed at a leading edge of the cutting arm 2210, and be configured to provide a cutting action in operation with a stationary plate cutting edge 2326 (e.g., stationary axial cutting edge) disposed on one or more of the respective second set of plate intake ports 2216 (e.g., axial intake port). Further, the radial cutting edge 2436 can be disposed on a distal end of the cutting arm 2210, and be configured to provide a cutting action in operation with one or more of the wall cutting edges 2324.

In one implementation, one or more of the second set of plate intake ports 2216 can respectively comprise an ellipse shape (e.g., circle or oval shaped), and/or an elongated ellipse shape (e.g., elongated circle and/or ellipse). In this way, for example, the elongated portion of the intake port 2216 can provide a longer cutting edge with the axial cutting edge 2434 of the cutting arm 2210, thereby improving the cutting action acting on fluid entrained solids. Further, in one implementation, the second set of plate intake ports 2216 can be disposed on the stationary cutter plate 2208 in a pattern configured to provide efficient and effective solids cutting/shearing action. In another implementation, the second set of plate intake ports 2216 can be disposed on the stationary cutter plate 2208 substantially random alignment. For example, a random alignment may allow for multiple and varied interaction with fluids entrained solids between the axial cutting edge 2434 of the cutting arm 2210 and the second set of plate intake ports 2216, such as with the stationary plate cutting edge 2326.

In one implementation, the second set of plate intake ports 2216 can be disposed in a generally radial alignment on the stationary cutter plate 2208 between the hub portion 2212 and the perimeter 2206. For example, an elongated intake port 2216 can be aligned radially in order to provide for a longer cutting action between the axial cutting edge 2434 of the cutting arm 2210 and the intake port 2216 while the cutting arm 2210 rotates around the stationary cutter plate 2208. Further, a radially aligned intake port 2216 can allow for improved and more efficient fluid flow radially from the hub portion 2212 out to the wall 2206. In this way, the first set of intake ports 2214 may receive a portion of the fluid intake.

In one implementation, the stationary cutter plate 2208 can comprise one or more channels 2328 that are respectively, fluidly coupled with at least one of the second set of plate intake ports 2216. Further, the one or more channels 2328 can be respectively, fluidly coupled with at least one of the first set of plate intake ports 2216. As an example, the channel 2328 can be configured to facilitate translation of fluid and/or solids from a central area (e.g., the hub portion 2212) toward the inside portion of the wall 2206. Further, in one implementation, a channel may be disposed between the hub portion 2212 and the inside portion of the wall 2206, such as leading to respective perimeter intake ports 2214. Additionally, one or more interior intake ports 2216 may be disposed along a channel 2328. In this implementation, a channel leading from an interior intake port 2216 may facilitate movement of sheared solids toward inside portion of the wall 2206. In one implementation, one or more or the channels may terminate at a perimeter intake port 2214. In this way, for example, solids that are translated along a channel 2328 toward the perimeter intake port 2214 may be subjected to the radial shearing action of the radial cutting edge 2434 combined with the terminal end of a rotating cutting arm 2210. In one implementation, a direction, length and design of the respective channels 2328 may be determined based on use conditions of the cutter/grinder system 2200, for example, a speed of the rotating arms 2210, size of solids, expected head pressure, pipe diameters, fluid characteristics, and other conditions.

In one implementation, the stationary cutter wall 2206 can comprise one or more sub-planar cut-outs 2330 that are disposed on the intake side of the stationary cutter wall 2206. The one or more sub-planar cut-outs 2330 can be fluidly coupled with at least one wall intake port 2214. As an example, the respective sub-planar cut-outs 2330 may be configured to mitigate clogging of the cutter/grinder system 2200, and/or to improve flow of a fluid comprising solids through the intake ports 2214, 2216. As an example, a location and size of the sub-planar cut-outs 2330 can provide for improved solids shearing/grinding action results. For example, a size, location, number and depth of a sub-planar cut-outs 2330 may vary depending on an expected application of the assembly 2200 (e.g., amount and type of solids, type of fluid, pipe size, head pressure, etc.).

Figure 23A:
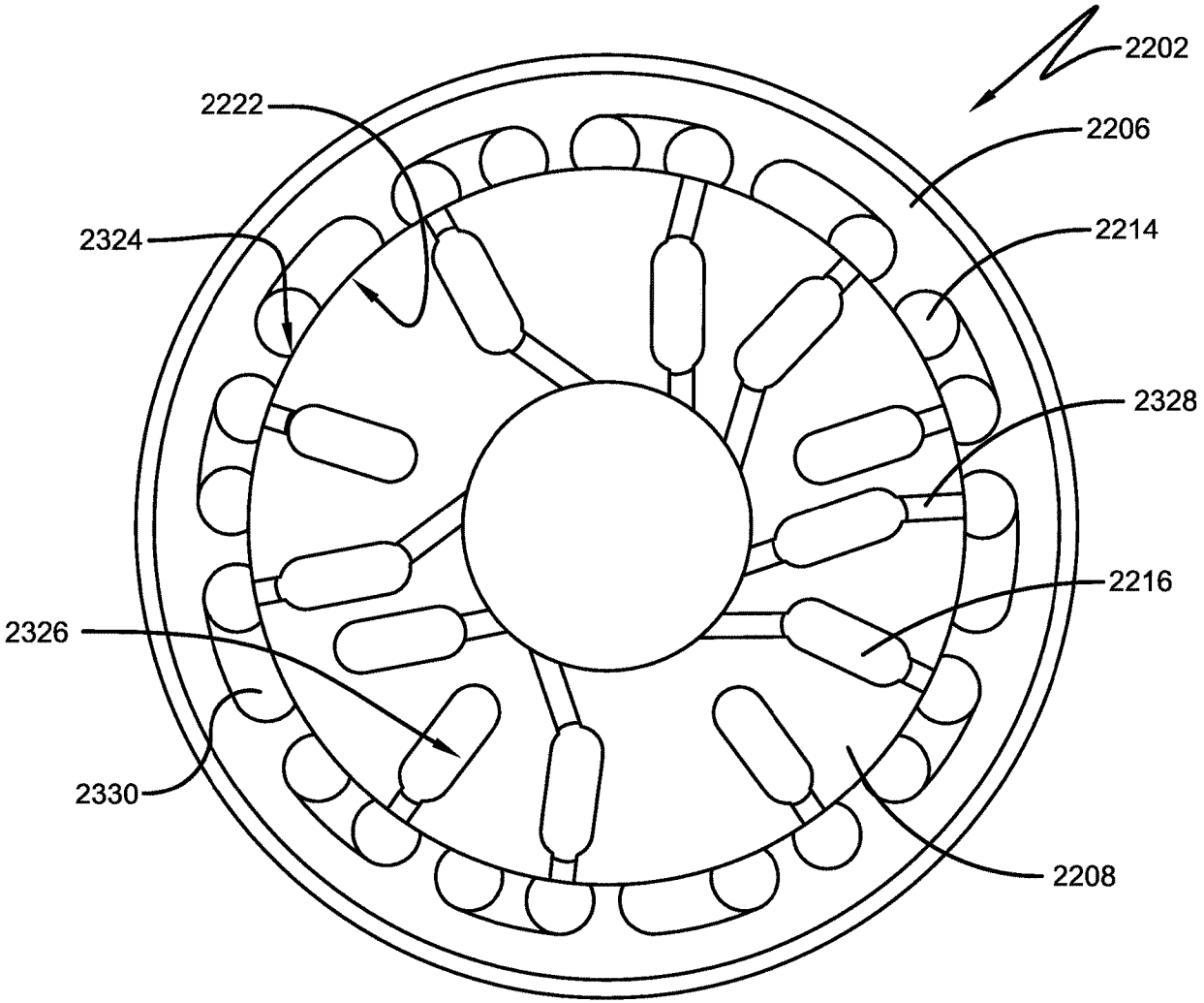
FIG. 23A is a component diagram illustrating a top view of an example implementation of one or more portions of one or more components described herein.
Figure 23B:
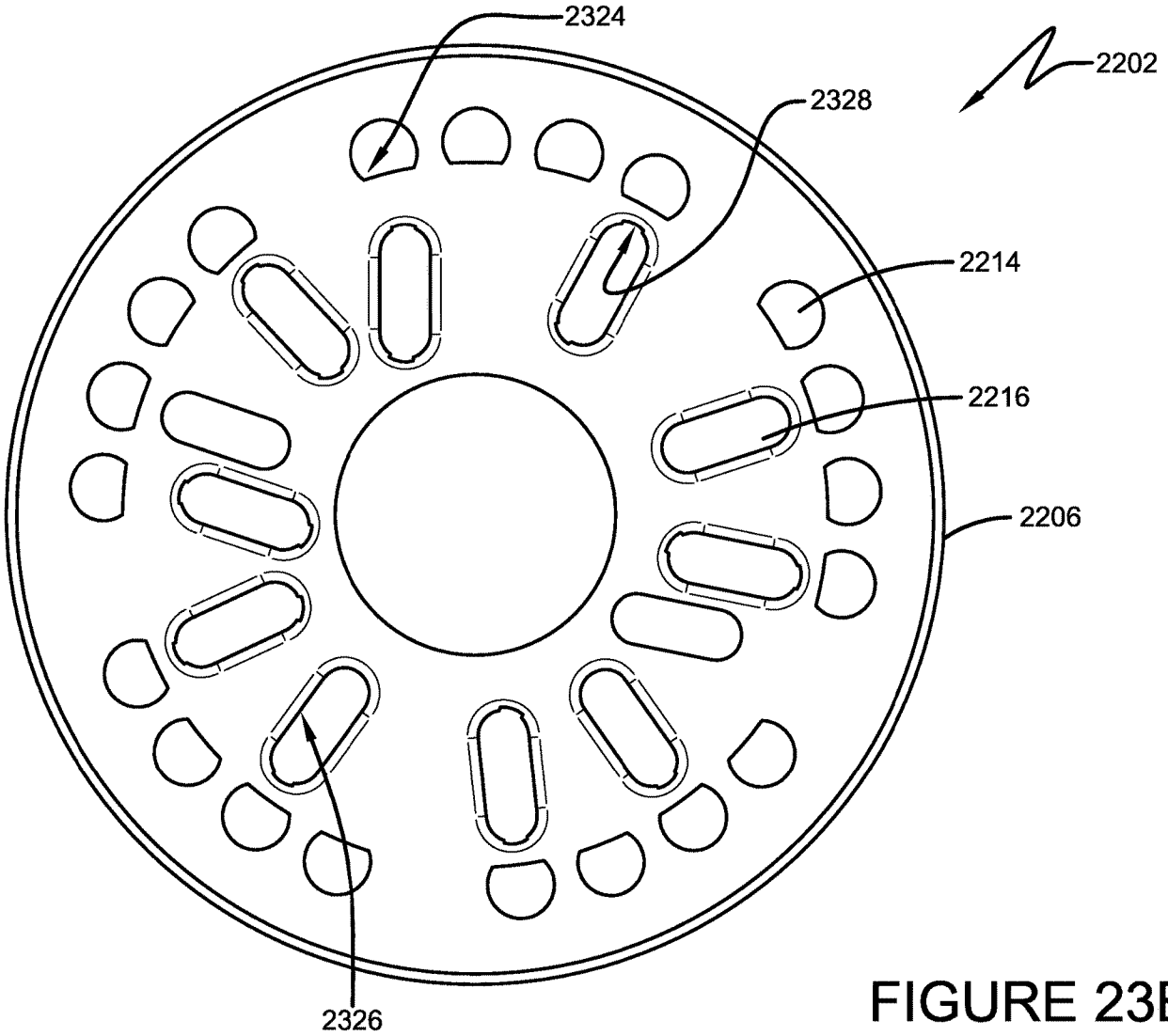
FIG. 23B is a component diagram illustrating a bottom view of an example implementation of one or more portions of one or more components described herein.
Figure 23C:
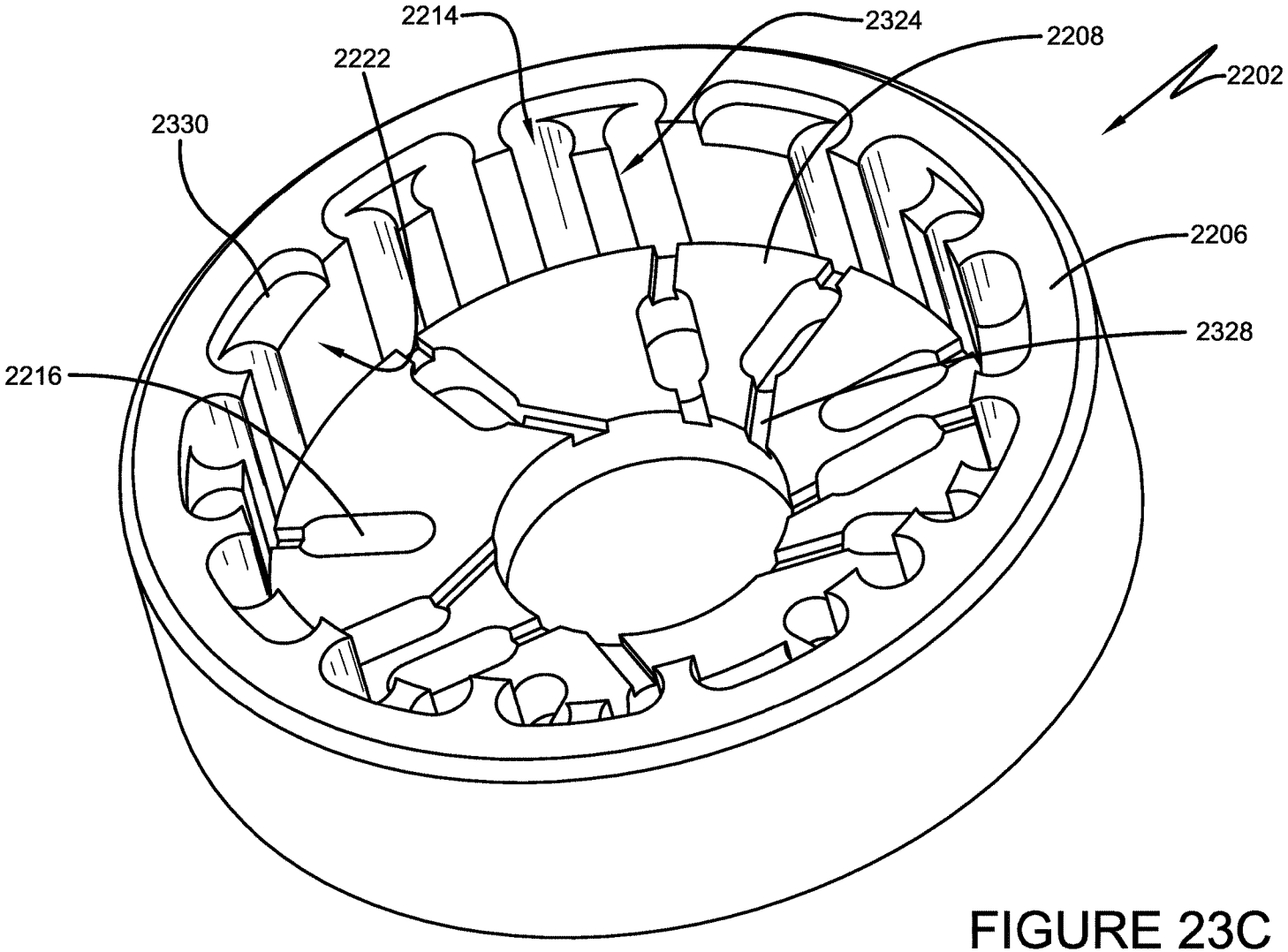
FIG. 23C is a component diagram illustrating a side-top perspective view of an example implementation of one or more portions of one or more components described herein.
Figure 24A:
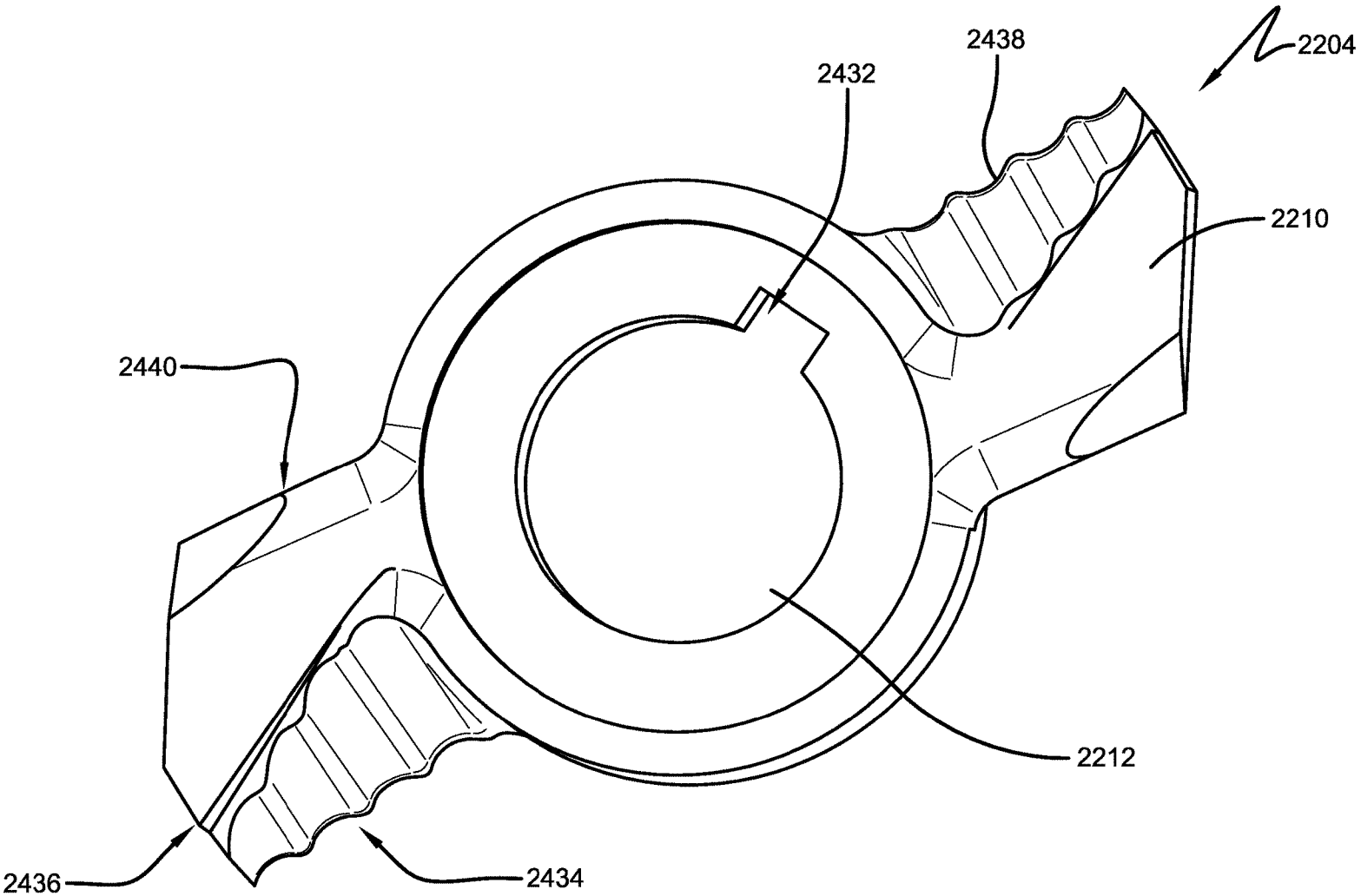
FIG. 24A is a component diagram illustrating a top view of an example implementation of one or more portions of one or more components described herein.
Figure 24B:
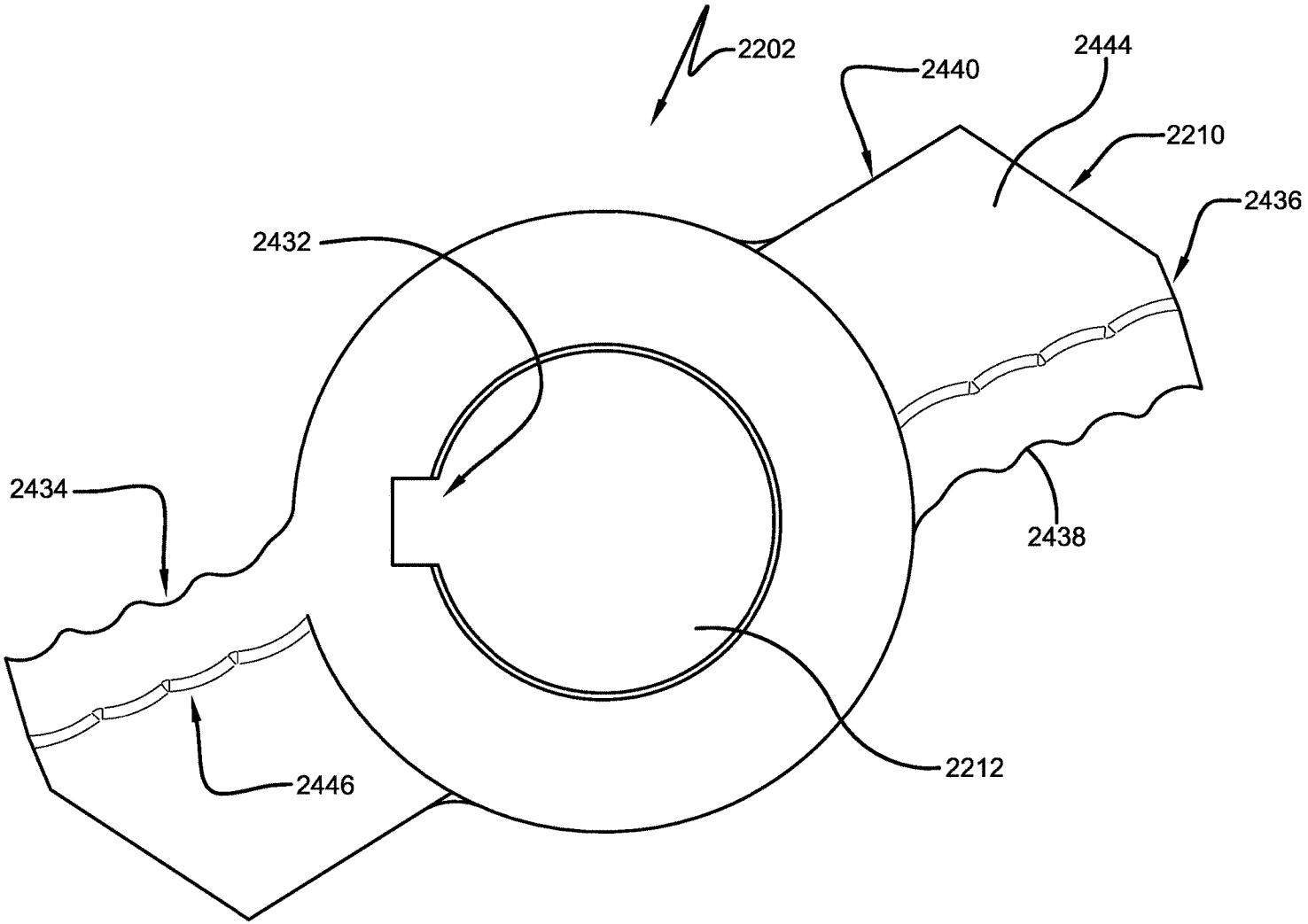
FIG. 24B is a component diagram illustrating a bottom view of an example implementation of one or more portions of one or more components described herein.
Figure 24C:
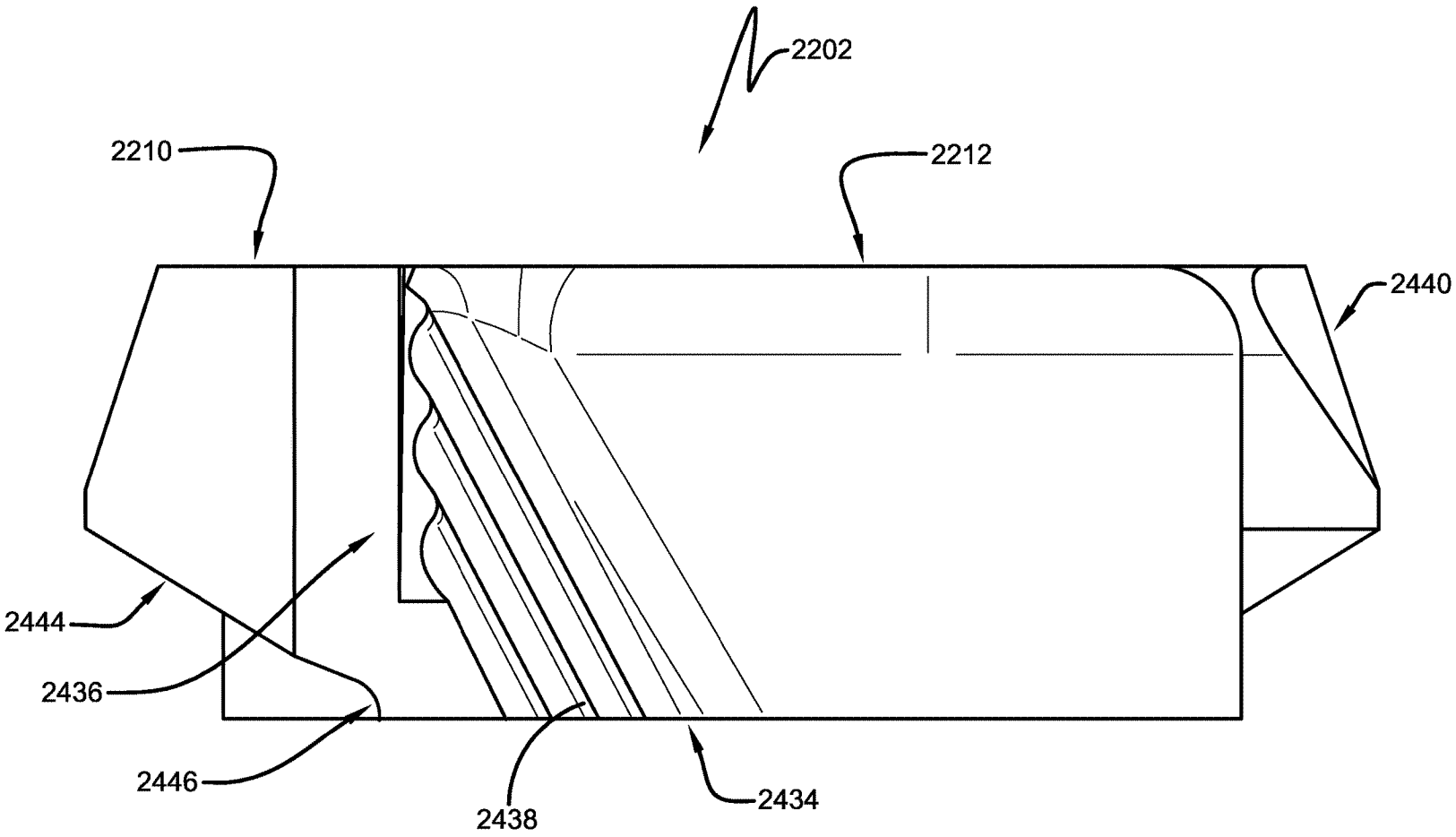
FIG. 24C is a component diagram illustrating a side view of an example implementation of one or more portions of one or more components described herein.

In one implementation, the one or more of the respective wall intake ports 2214 can comprise a major arc shape, where the wall cutting edge 2324 is disposed at a trailing point of the major arc shape. For example, as illustrated in FIG. 23A, the shape of the perimeter wall intake port 2214 comprises a major arc (e.g., where two points on a circle define two arcs, a major arc and a minor arc, when the points are not directly across from each other). That is, for example, a major arc comprises greater than a one-hundred and eighty degrees of a circle. In this implementation, the trailing point (e.g., the second point of the port 2214 addressed by the radial cutting edge 2436 when the rotating cutter 2204 is rotating) can comprise the wall cutting edge 2324. In this way, for example, the major arc shape of the wall intake ports 2214 can provide a more acute cutting edge for the wall cutting edge 2324 than be provided by slits or half-circle shaped slots. For example, the acute shape provided by the major arc shape of the wall cutting edge 2324 can improve the cutting/shearing action between the wall cutting edge 2324 and the radial cutting edge 2436.

In one implementation, one or more of the radial cutting edges 2436 can comprise a first cutting angle and a second cutting angle. For example, the radial cutting edge 2436 can comprise a different cutting angle (e.g., first, second, third, fourth, etc.). In this way, in this example, engaged solids entrained in a fluid may be operated upon from different angles to provide a more effective cutting/shearing action. In this way, for example, having varied cutting angles and/or positions may provide for a more effective cutting/grinding of solid matter, such as by impacting the matter at various locations (e.g., and at different cutting angles) during rotating cutter 2204 rotation.

In one implementation, the respective cutting arms 2210 can comprise a serrated surface 2438 disposed at the leading side, which can provide a serrated axial cutting edge 2434. As an example, a serrated cutting edge can comprise a plurality of smaller points of contact with the solid matter, entrained in the fluid, subjected to the shearing action. For example, having a smaller contact area than a straight edge allows applied pressure at each point of contact to impart a greater force to the subject solids. Further, the curved nature of the serrated edges 2438 can provide a sharper angle to the material being acted upon. In this example, this may result in an improved cutting/shearing action in conjunction with the shape of the interior intake port cutting edge 2326, for example, particularly as the cutter arm 2210 rotates around the base plate 2208.

Additionally, the rotating cutter can comprise a relief portion 2446 that is disposed at a trailing edge of one or more of the cutting arms 2210, and configured to mitigate a cavitation effect. For example, a shape, size and/or angle of disposition of the trailing edge 2440 can be configured to mitigate a cavitation effect that may result from the movable cutter 2204 rotating through a fluid. That is, for example, a lower pressure may form behind the cutter arm 2210 as it moves through the fluid (e.g., at the trailing side of the cutter arm). In this example, the lower pressure can allow fluid cavitation to occur, which may result in damage to the material (e.g., metal) forming the cutter arm 2210. Altering the shape of the trailing edge 2440, such as by using the relief portion 2446, and/or a shape, size, and placement of an underside 2444 of the cutting arm 2210, can help mitigate this lower pressure behind the cutter arm 2210, thereby mitigating potential damage to the cutter arm 2210.

In one aspect, a method for using a pump, comprising a solids cutting/shearing assembly/system, can be devised. In one implementation, in this aspect, a method can comprise installing a pump in a system for transporting a fluid that comprises a mixture of fluids and solids (e.g., a wastewater system). In this implementation, the pump can comprise a stationary cutter that is operably coupled with an intake end of the pump. In this implementation, the stationary cutter can comprise a perimeter wall projecting in a substantially transverse direction from the intake side of the pump, where the wall comprising a plurality of perimeter intake ports, respectively comprising a radial cutting edge. Further, the stationary cutter can comprise a plurality of interior intake ports disposed on a base of the stationary cutter, where the plurality of interior intake ports respectively comprising an axial cutting edge.

In this implementation of an exemplary method, the pump can additionally comprise a movable cutter engaged with a rotating shaft of the pump in operable engagement with the stationary cutter and can be configured to rotate to engage with the solids. The movable cutter can comprise two or more cutting arms that are projecting radially from a central hub of the rotating cutter. Further, the movable cutter can comprise a first cutting edge that is disposed on a leading side of respective cutting arms, and can be configured to provide a cutting action in combination with one or more of the axial cutting edges. The movable cutter can also comprise a second cutting edge that is disposed on respective cutting arms, and can be configured to provide a cutting action in combination with one or more of the radial cutting edges.

In this implementation, the example method may also include placing the pump in a condition that allows it to be activated in a manner that provides a reduction in a size of the solids in the fluid for pumping. For example, the pump, comprising the cutter assembly, can be placed in use at a wastewater system, and activated to provide cutting, grinding and or shearing of solids entrained in fluid disposed in the wastewater system.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

What is claimed is:

1. A cutter system for a pump, comprising:

a stationary cutter plate configured to operably couple with an intake area of a pump in a stationary disposition, the stationary cutter plate comprising a plurality of intake ports, the plurality of intake ports comprising:

a first set of plate intake ports disposed around a perimeter portion of the stationary cutter plate; and a second set of plate intake ports disposed in an interior portion of the stationary cutter plate;

a stationary cutter wall fixedly engaged with the stationary cutter plate, and projecting in a substantially transverse direction from the perimeter of an intake side of the stationary cutter plate, the stationary cutter wall comprising a set of wall intake ports disposed in substantial alignment with the respective first set of plate intake ports, one or more of the respective wall intake ports comprising a wall cutting edge;

a rotating cutter configured to operably couple with a rotating shaft of the pump, and comprising a plurality of cutting arms projecting radially from a central hub portion of the rotating cutter, respective cutting arms comprising:

an axial cutting edge; and a radial cutting edge.

2. The system of claim 1, the second set of plate intake ports respectively comprising a stationary plate cutting edge.

3. The system of claim 1, one or more of the second set of plate intake ports respectively comprising one of:

an ellipse shape; and an elongated ellipse shape.

4. The system of claim 1, the second set of plate intake ports disposed in substantially random alignment on the stationary cutter plate.

5. The system of claim 1, the second set of plate intake ports disposed in a generally radial alignment on the stationary cutter plate between the hub portion and the perimeter.

6. The system of claim 1, the axial cutting edge disposed at a leading edge of the cutting arm, and configured to provide a cutting action in operation with one or more of the second set of intake ports.

7. The system of claim 1, the radial cutting edge disposed on a distal end of the cutting arm, and configured to provide a cutting action in operation with one or more of the wall cutting edges.

8. The system of claim 1, the stationary cutter plate comprising one or more channels respectively fluidly coupled with at least one of the second set of plate intake ports.

9. The system of claim 8, the one or more channels respectively fluidly coupled with at least one of the first set of plate intake ports.

10. The system of claim 1, the stationary cutter wall comprising one or more sub-planar cut-outs disposed on the intake side of the stationary cutter wall, and respectively fluidly coupled with at least one wall intake port.

11. The system of claim 1, one or more of the respective wall intake ports comprising a major arc shape, and the wall cutting edge disposed at a trailing point of the major arc shape.

12. The system of claim 1, the respective cutting arms comprising a serrated surface disposed at a leading side, resulting in a serrated axial cutting edge.

13. The system of claim 1, the rotating cutter comprising a cutter hub configured to selectably engage with the shaft of a pump.

14. The system of claim 1, one or more of the radial cutting edges comprising a first cutting angle and a second cutting angle.

15. The system of claim 1, the rotating cutter comprising a relief portion disposed at a trailing edge of one or more of the cutting arms, and configured to mitigate a cavitation effect.

16. A fluids pump comprising:

a stationary cutter base disposed at an intake end of the pump, the stationary cutter base comprising:

a wall disposed around the perimeter of the base, and projecting in a substantially transverse direction from an intake side of the base, the wall comprising a plurality of radial intake ports, respectively comprising a stationary radial cutting edge; and a plurality of axial intake ports disposed on the base between the wall and a central hub portion, the plurality of axial intake ports respectively comprising a stationary axial cutting edge; and a rotating cutter selectably engaged with a rotating shaft of the pump at the intake side of the base, the rotating cutter comprising:

at least two cutting arms projecting radially from the central hub;

a moving axial cutting edge disposed on respective cutting arms, and configured to provide a cutting action in combination with one or more of the stationary axial cutting edges; and a moving radial cutting edge disposed on a distal end of one or more of the respective cutting arms, and configured to provide a cutting action in combination with one or more of the stationary radial cutting edges.

17. The pump of claim 16, the base comprising one or more of:

one or more channels disposed on the intake side, respective one or more channels fluidly coupled with one or more of the radial intake ports or axial intake ports; and one or more sub-planar cut-outs disposed on the intake side of the wall, and respectively fluidly coupled with at least one radial intake port.

18. The pump of claim 16, the respective cutting arms comprising a serrated surface disposed at a leading side, resulting in a serrated moving axial cutting edge.

19. The pump of claim 16, one or more of the moving radial cutting edges comprising a first cutting angle and a second cutting angle respectively configured to interact with the stationary radial cutting edge at different angles.

20. A method for utilizing a pump, comprising:

installing a pump in a system for transporting a fluid that comprises a mixture of fluids and solids, the pump comprising:

a stationary cutter operably coupled with an intake end of the pump, the stationary cutter comprising:

a perimeter wall projecting in a substantially transverse direction from the intake side of the pump, the wall comprising a plurality of perimeter intake ports, respectively comprising a radial cutting edge; and a plurality of interior intake ports disposed on a base of the stationary cutter, the plurality of interior intake ports respectively comprising an axial cutting edge; and a movable cutter engaged with a rotating shaft of the pump in operable engagement with the stationary cutter and configured to rotate to engage with the solids, the movable cutter comprising:

two or more cutting arms projecting radially from a central hub of the rotating cutter;

a first cutting edge disposed on a leading side of respective cutting arms, and configured to provide a cutting action in combination with one or more of the axial cutting edges; and a second cutting edge disposed on respective cutting arms, and configured to provide a cutting action in combination with one or more of the radial cutting edges; and placing the pump in a condition that allows it to be activated in a manner that provides a reduction in a size of the solids in the fluid for pumping.

* * * * *